US008187126B2

(12) United States Patent
Martino

(10) Patent No.: US 8,187,126 B2
(45) Date of Patent: May 29, 2012

(54) SELF-PROPELLED FOOTBALL WITH INTERNALLY DUCTED FAN AND ELECTRIC MOTOR

(76) Inventor: Marc Gregory Martino, Westlake Village, CA (US)

( * ) Notice: Subject to any disclaimer, the term of this patent is extended or adjusted under 35 U.S.C. 154(b) by 981 days.

(21) Appl. No.: 11/789,223

(22) Filed: Apr. 24, 2007

(65) Prior Publication Data

US 2008/0039250 A1 Feb. 14, 2008

Related U.S. Application Data

(63) Continuation-in-part of application No. 11/500,749, filed on Aug. 8, 2006.

(51) Int. Cl.
*A63B 71/02* (2006.01)

(52) U.S. Cl. ..... 473/613; 473/570

(58) Field of Classification Search ..... 473/570, 473/613; 273/108.4, 317.5
See application file for complete search history.

(56) References Cited

U.S. PATENT DOCUMENTS

| | | | | |
|---|---|---|---|---|
| 3,884,466 | A | 5/1975 | MacDonald | |
| 4,736,948 | A | 4/1988 | Thomas | |
| 4,923,196 | A | 5/1990 | Rohring | |
| 5,133,550 | A | 7/1992 | Handy | |
| RE34,383 | E | 9/1993 | Rohring | |
| 5,269,514 | A | 12/1993 | Adler | |
| 5,779,576 | A | 7/1998 | Smith | |
| 6,010,419 | A | 1/2000 | Rappaport | |
| 6,024,660 | A * | 2/2000 | Romanick | 473/596 |
| 6,120,398 | A | 9/2000 | Myers | |
| 6,157,898 | A * | 12/2000 | Marinelli | 702/141 |
| 6,669,587 | B2 | 12/2003 | Kessler | |
| 2004/0169485 | A1 * | 9/2004 | Clancy | 318/588 |
| 2006/0144994 | A1 * | 7/2006 | Spirov et al. | 244/62 |

* cited by examiner

*Primary Examiner* — Peter DungBa Vo
*Assistant Examiner* — Allen Chan
(74) *Attorney, Agent, or Firm* — Marc Martino

(57) ABSTRACT

Disclosed is a self-propelled football with an internally ducted fan and electric motor. An exemplary embodiment has an oblate spheroidal body. The body has a front section, a center section, a back section, and a longitudinal axis. The ducted fan is located within the body substantially within the center section and substantially along the longitudinal axis. The electric motor is located within the body and mechanically coupled to the ducted fan. At least one electrical power source is located within the body and electrically coupled to the electric motor. At least one air-inlet is located within the front section of the body in airflow communication with the ducted fan. At least one air-outlet is located within the back section of the body in airflow communication with the ducted fan. A means for automatic activation and deactivation of the electrical motor is located within the body.

19 Claims, 15 Drawing Sheets

SELF-PROPELLED FOOTBALL WITH INTERNALLY DUCTED FAN AND ELECTRIC MOTOR

CROSS-REFERENCE TO RELATED APPLICATIONS

This patent application is a continuation-in-part to the original application Ser. No. 11/500,749 filed on Aug. 8, 2006.

FIELD OF THE INVENTION

The present invention relates in general to a football, and in particular to a self-propelled football with an internally ducted fan and electric motor.

BACKGROUND OF THE INVENTION

American football is a very popular sport in the United States. Footballs come in a multitude of shapes, sizes, and materials. Some footballs are replicas of the leather footballs used in the collegiate and professional leagues. Other footballs may be made of an elastic foam which is resilient and compressible. This foam lessens the impact of the football making it safer for use. Some footballs may be geometrically sized and shaped to improve the distance they are able to be thrown.

One attempt to improve travel distance included a propeller enhanced football. This football has fins extending from the rear of the football where a propeller is externally located. The propeller is soft, so as not to injure a player. This is necessitated because the propeller is exposed and not internally located within the football. The football doesn't behave like a normal football, as it has fins extending out the back and an external propeller. The football is suited only for throwing. It is not intended to be played in a football game where handoffs, lateral passes, pitches and kicks occur. Furthermore, since the propeller is exposed and soft, the power produced by the football is weak at best and not much self-propulsion truly occurs.

Some have developed an engine-spiraled, stabilized football through an internal combustion engine. This football has the internal combustion engine located within the football that drives a propeller housed within a gyroscopic propeller ring. The internal combustion engine requires a fuel. Therefore, players must put into the football a combustible fuel, like gasoline. Combustible fuels and footballs don't go well with each other. Gasoline is a dangerous chemical that is not suited for a children's toy. Furthermore, an internal combustion engine produces heat which could present a fire hazard. The internal combustion engine could also burn a player when the football is handled. Compounding these dangers are the exhaust gases produced by the internal combustion engine. Playing with a football that emits toxic fumes is highly undesirable. Also, there is no control technology devised in the football that allows the football to easily self activate and deactivate when thrown. Therefore the engine must be started and left running while in use. Also, an external starter is needed to start the motor before the engine will operate. For all of the aforementioned reasons and others not discussed, the internal combustion engine should not be placed within a football intended for use by people, especially children.

SUMMARY OF THE INVENTION

A self-propelled football is disclosed. An exemplary embodiment of the self-propelled football has an oblate spheroidal body. The body has a front section, a center section, a back section, and a longitudinal axis. A ducted fan is located within the body substantially along the center section and substantially along the longitudinal axis. An electric motor is located within the body and is mechanically coupled to the ducted fan. At least one electrical power source is located within the body and electrically coupled to the electric motor. At least one air-inlet is located within the front section of the body in airflow communication with the ducted fan. At least one air-outlet is disposed along the back section of the body in airflow communication with the ducted fan. A means for automatic activation and deactivation of the electrical motor by detecting an in-flight condition and a not-in-flight condition is located within the body.

BRIEF DESCRIPTION OF THE DRAWINGS

Referring now to the drawings in which like reference numbers represent corresponding parts throughout.

DETAILED DESCRIPTION

In the following description of the exemplary embodiments, reference is made to the accompanying drawings that form a part hereof, and in which is shown merely by way of illustration. It is to be understood that other embodiments may be used and structural changes may be made without departing from the scope of the present invention.

Figure 1:
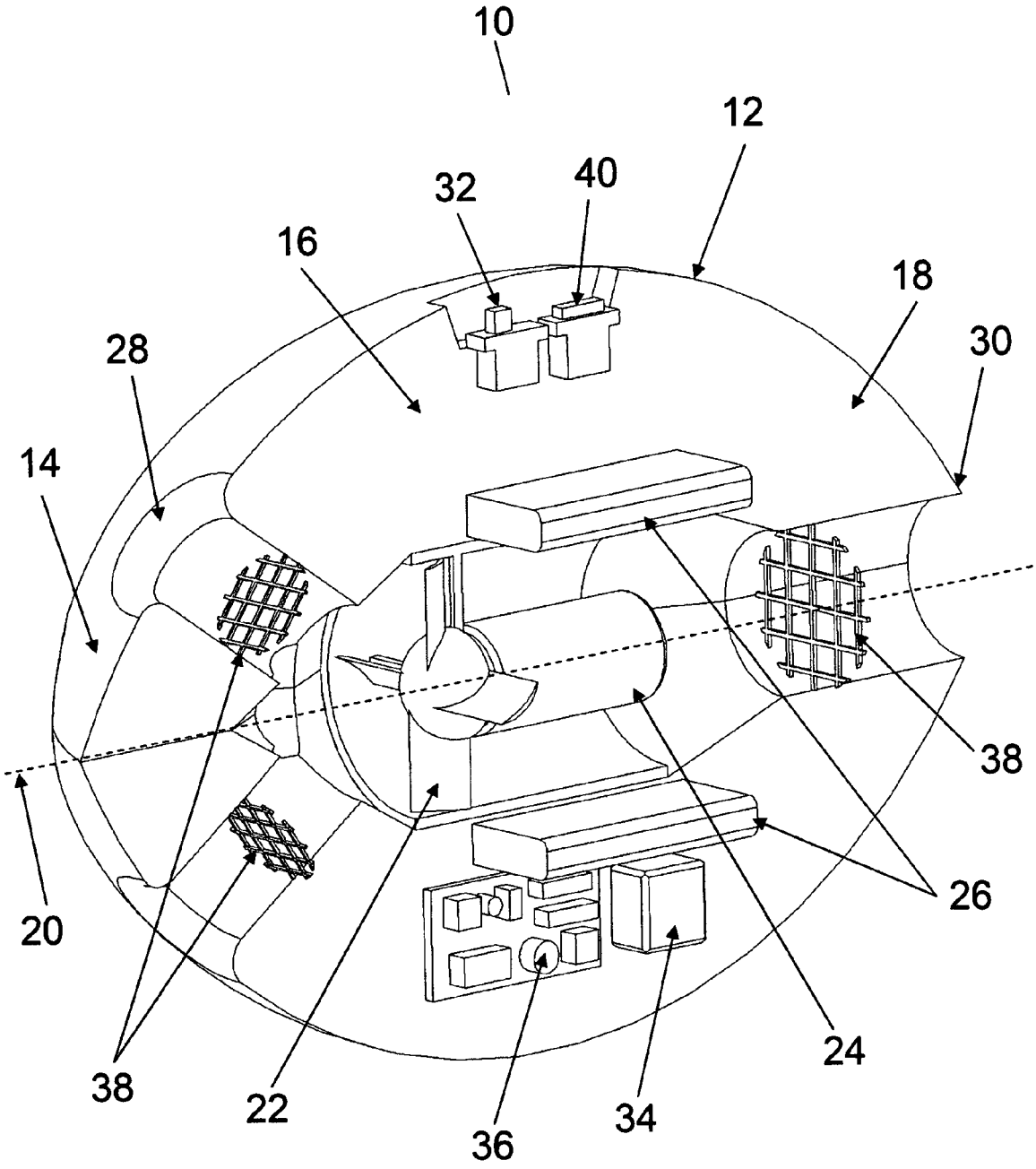
FIG. 1 illustrates an embodiment of a self-propelled football in a cross-sectional isometric view.
Figure 2:
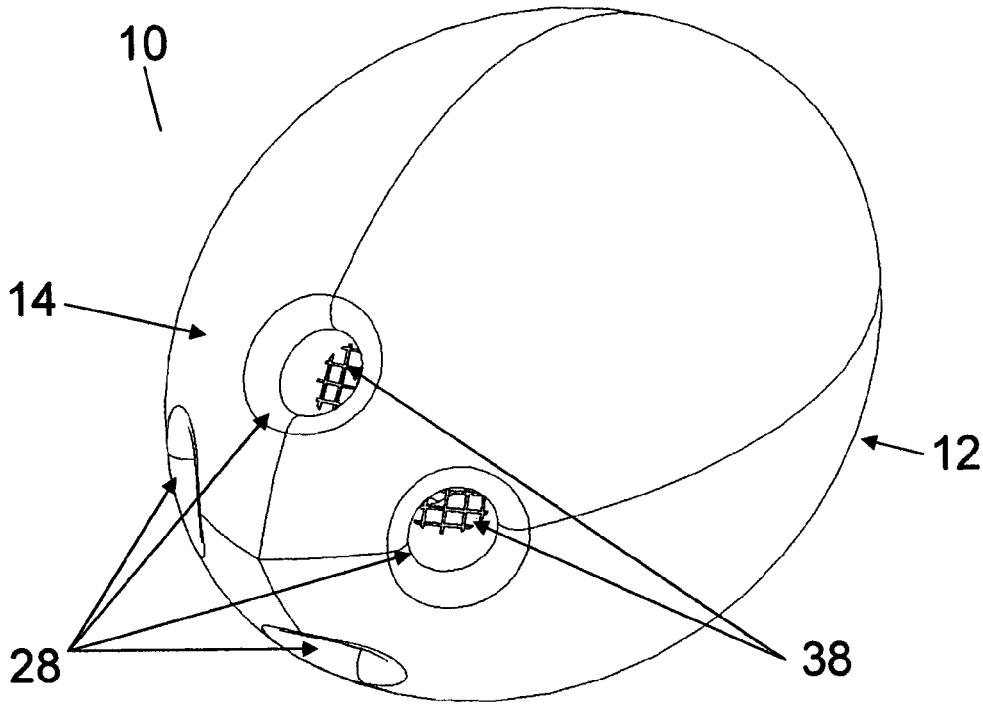
FIG. 2 illustrates the embodiment of FIG. 1 in an isometric view from the front.
Figure 3:
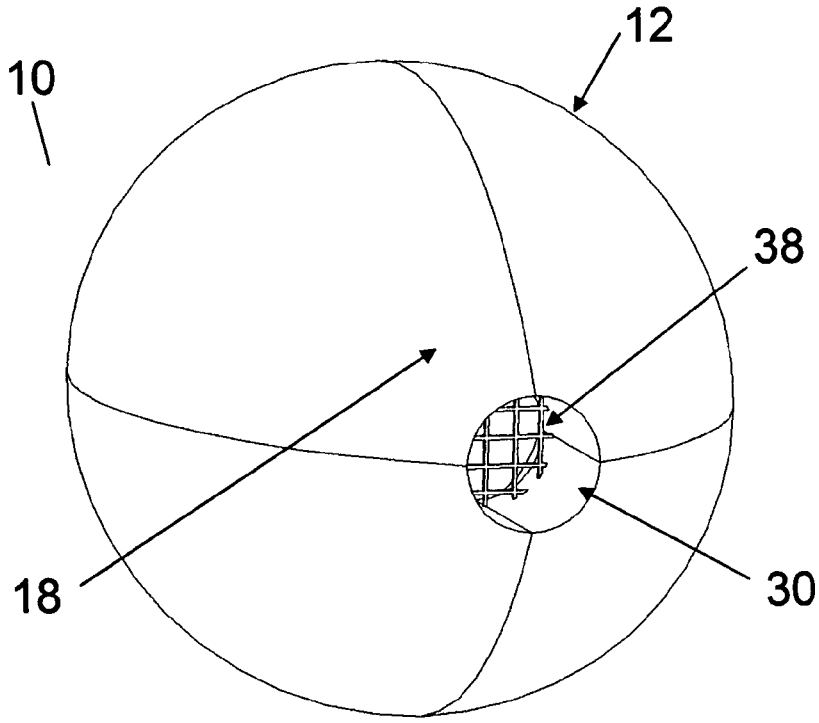
FIG. 3 illustrates the embodiment of FIG. 1 in an isometric view from the back.

An embodiment of a self-propelled football is shown in FIGS. 1-3. The self-propelled football 10 has a body 12 defined as having a front section 14, a center section 16, a rear section 18 and a longitudinal axis 20. The body 12 is football-shaped. Football-shaped may be described as an oblong spheroidal body or as having a convex outer surface and generally pointed ends along the longitudinal axis 20. The longitudinal axis 20 may also be described as a rotational axis. When a football is thrown in a proper spiral, the football has a substantially parabolic flight trajectory from a passer to a catcher. As the football travels along this parabolic flight trajectory, the football translates forward along the longitudinal axis 20 while also rotating about the longitudinal axis 20. The rotation of the football about the longitudinal axis 20 helps to stabilize the football in flight. This spin (rotation/spiraling) makes the throw more accurate.

A ducted fan 22 is located within the body 12 along the center section 16. An electrical motor 24 is mechanically coupled to the ducted fan 22. The electrical motor 24 rotates the blades of the ducted fan 22 thereby producing a forward trust. Power for the electrical motor 24 comes from an electrical power source 26. The electrical power source 26 can be any suitable battery capable of storing and releasing electrical energy. Some examples of batteries used for similar applications are Nicad or NiMh packs. However, recent advances in lithium-polymer technology has lead to LiPo (lithium-polymer) packs that have twice the capacity at about half of the weight of comparable Nicad or NiMh packs. The technology of electric ducted fans and batteries have improved due to the increase in popularity of radio controlled model airplanes. Scale models of jet aircraft utilizing electric motors and batteries are capable of flying well over 150 miles per hour while being extremely light and lasting for longer run times than ever before.

Near the front section 14 are air-inlets 28 which converge to form an opening ahead of the ducted fan 22. The air-inlets 28 are located along front section 14 and converge together to form a common opening to the ducted fan 22. The air-inlets 28 allow an airflow to enter from the surrounding atmosphere to inside the football thereby supplying the airflow for the ducted fan 22. Air-inlets can be formed in a multitude of shapes and sizes.

Figure 4:
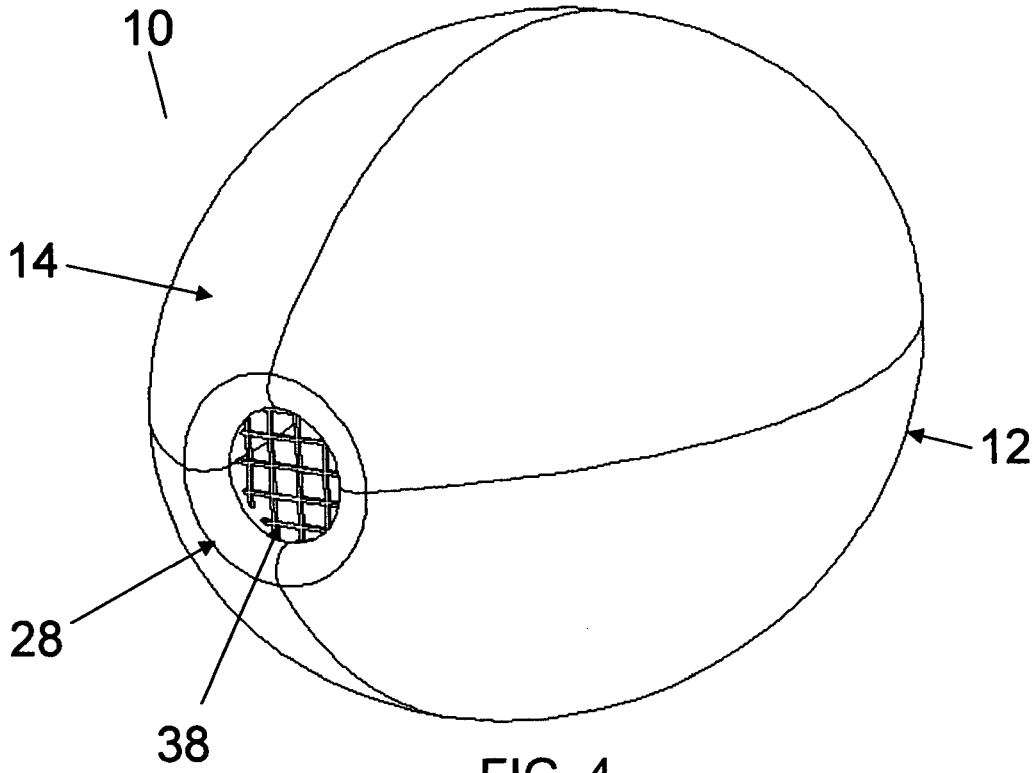
FIG. 4 illustrates another embodiment of a self-propelled football in an isometric view from the front.
Figure 5:
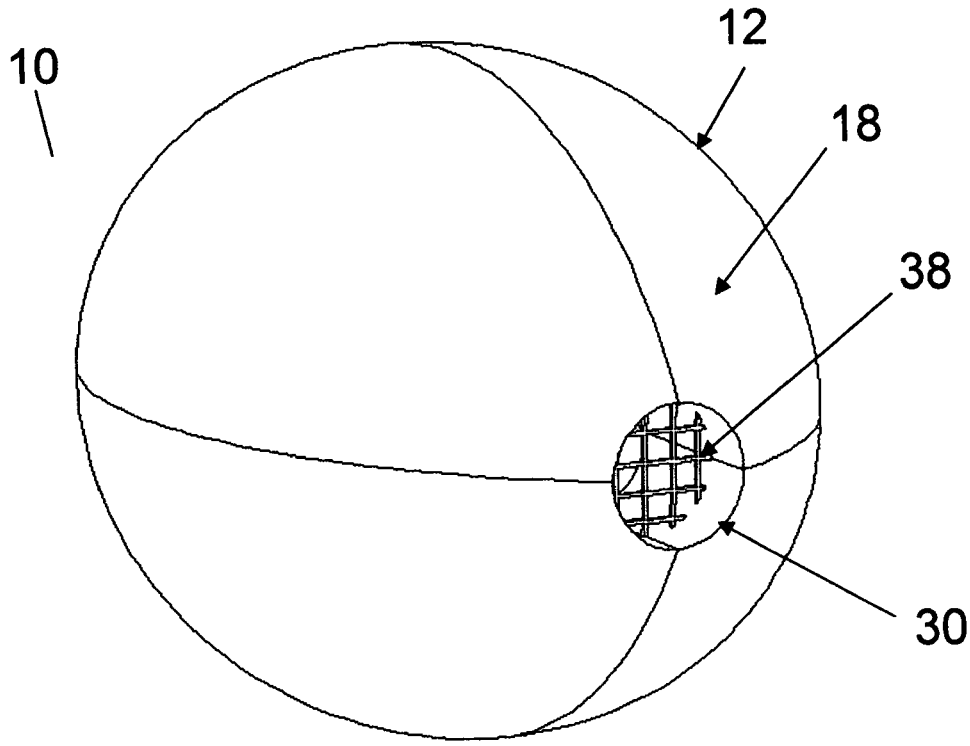
FIG. 5 illustrates the embodiment of FIG. 4 in an isometric view from the back.
Figure 6:
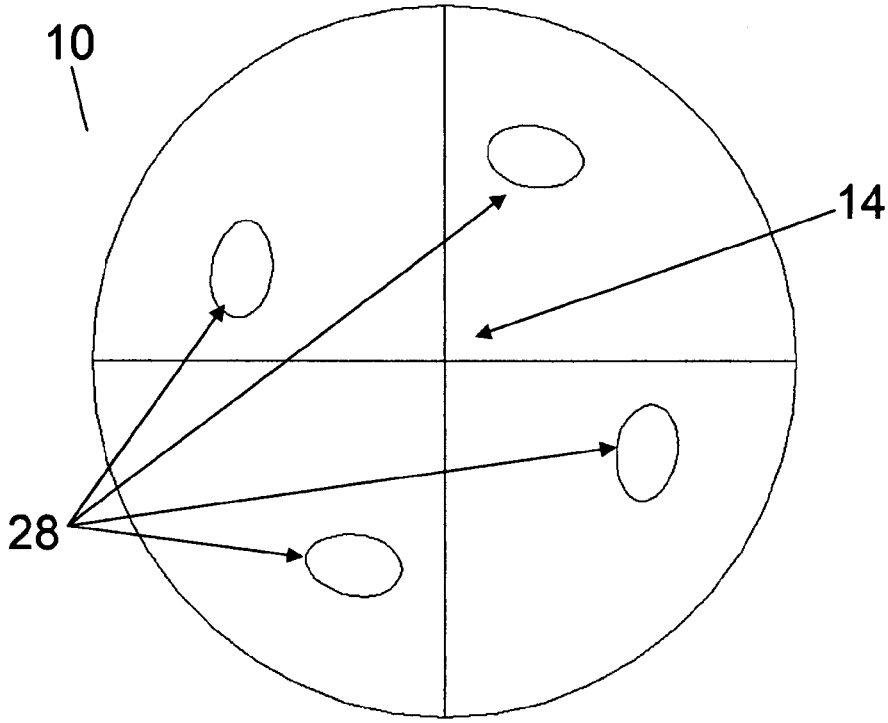
FIG. 6 illustrates an embodiment of a self-propelled football body in a front view.

Another embodiment of an air-inlet design is shown in FIGS. 4-5. The air-inlet 28 is a single opening along the longitudinal axis 20. This embodiment would allow the use of the football by either a right-handed user or a left-handed user. The right-handed user induces a clockwise spiral on the football when it is thrown. The left-handed user induces a counter-clockwise spiral on a football when it is thrown. A single opening along the longitudinal axis 20 would allow air to enter easily for either a clockwise or counter-clockwise spiral.

Figure 7:
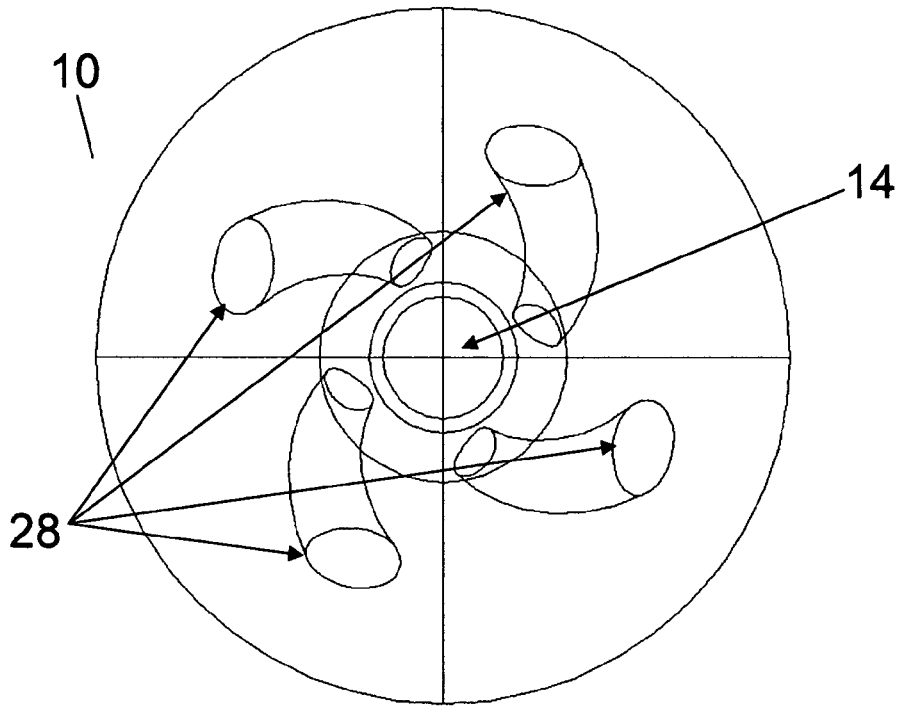
FIG. 7 illustrates the embodiment of FIG. 6 in a wire frame front view.
Figure 8:
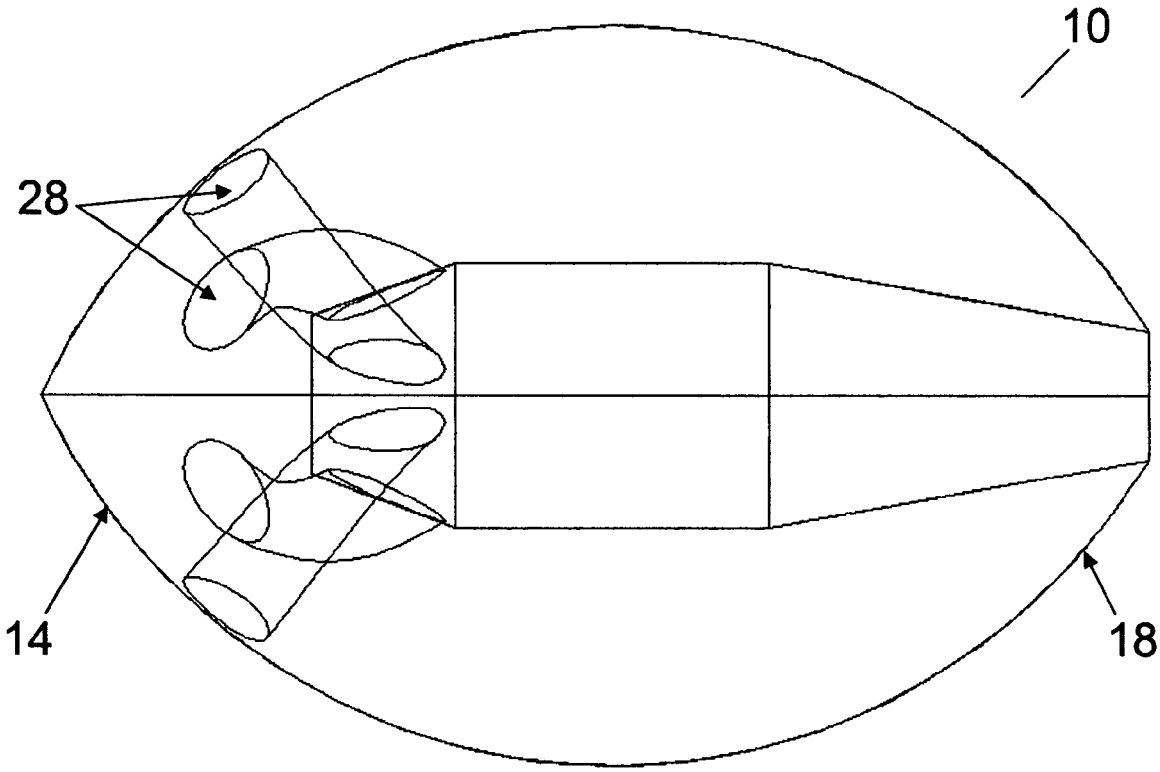
FIG. 8 illustrates the embodiment of FIG. 6 in a wire frame side view.
Figure 9:
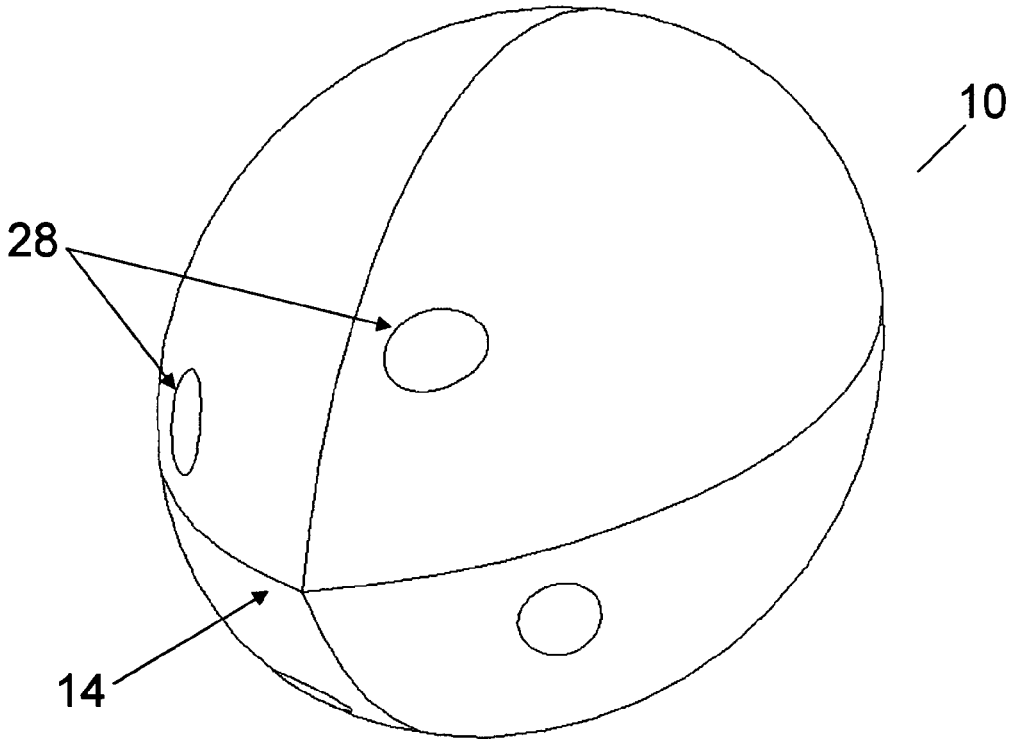
FIG. 9 illustrates the embodiment of FIG. 6 in an isometric view from the front.
Figure 10:
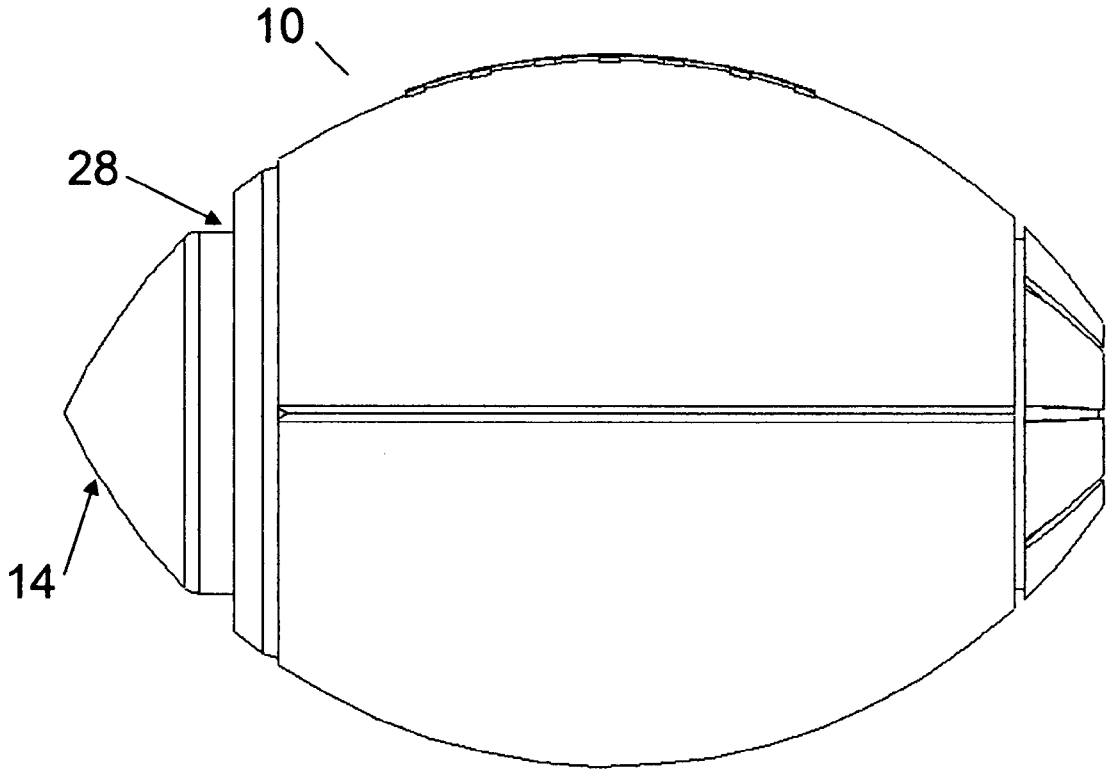
FIG. 10 illustrates another embodiment of a self-propelled football in a side view.
Figure 11:
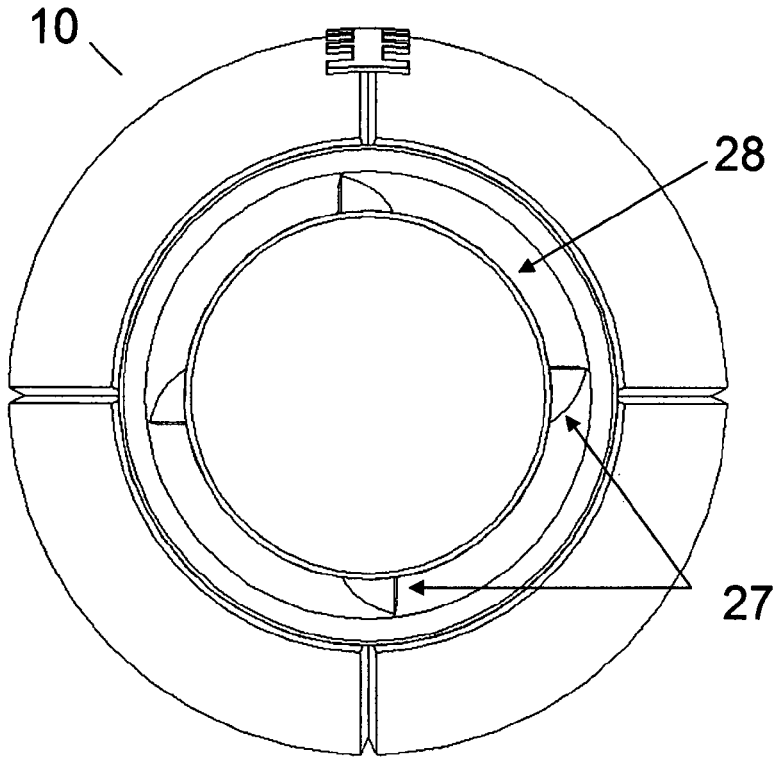
FIG. 11 illustrates the embodiment of FIG. 10 in a front view.
Figure 12:
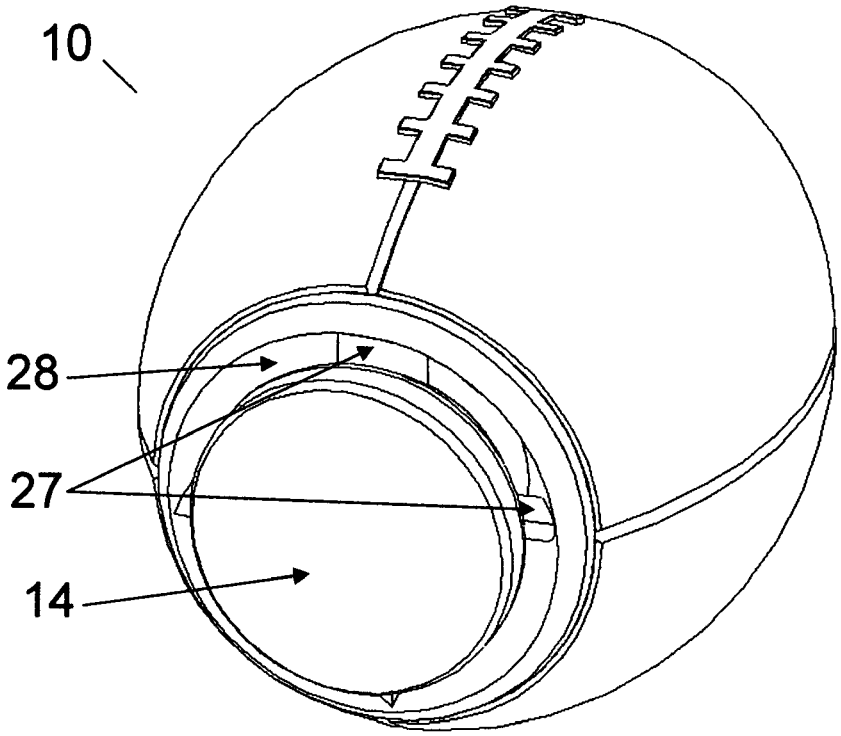
FIG. 12 illustrates the embodiment of FIG. 10 in an isometric view from the front.
Figure 13:
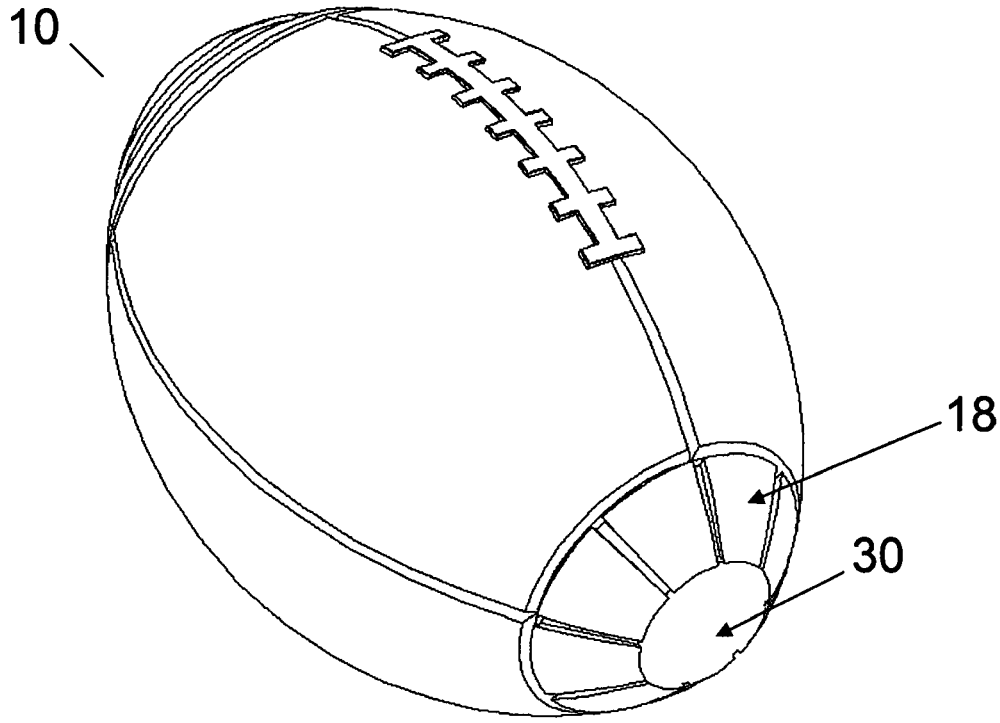
FIG. 13 illustrates the embodiment of FIG. 10 in an isometric view from the back.

Another embodiment of an air-inlet design is shown in FIGS. 6-9. A plurality of air-inlets 28 converge to the ducted fan 22 in a decreasing spiral radius beginning at the front section 14 and reducing in radius to form a common opening to the ducted fan 22. FIGS. 7-8 are shown in a wire frame view with the internal mechanisms removed to better see the decreasing spiral radius shape. Air-inlets 28 converge to ducted fan 22 while also being twisted in the direction the football will rotate when thrown. This decreasing spiral radius shape would take advantage of the spiral induced during a throw to better channel in airflow to the ducted fan 22. As the football spirals and travels forward during a throw, a corresponding air-inlet shape which takes advantage of the spiral would more efficiently channel airflow to the ducted fan 22. This embodiment would be right-hand biased or left-hand biased, as the decreasing spiral radius would need to be in the right orientation to effectively channel airflow during either a clockwise or counter-clockwise rotation.

Another embodiment of an air-inlet design is shown in FIGS. 10-13. The air-inlet 28 is a ring opening along the front section 14 that converges to form a common opening to the ducted fan 22. The volumetric airflow capacity of the ring opening can be designed to provide sufficient airflow capacity to the ducted fan 22 while minimizing deviation from the traditional football shape. In a further embodiment, structural supports 27 for the ring opening can be constructed to be right-hand biased or left-hand biased. The structural supports 27 would be shaped to effectively channel airflow during either a clockwise or counter-clockwise rotation.

Figure 14:
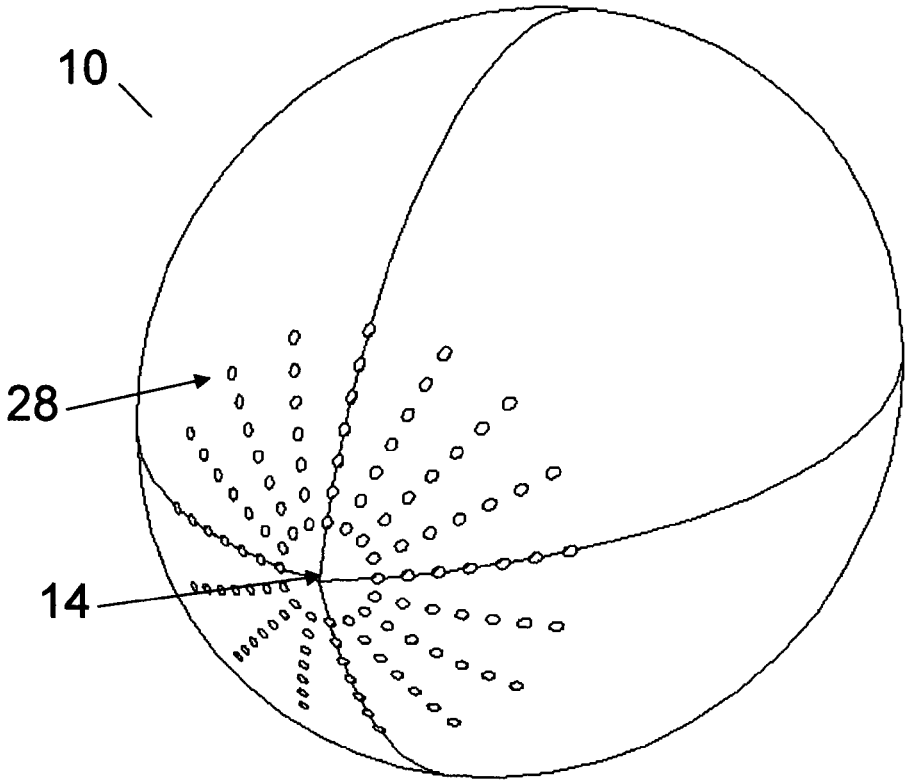
FIG. 14 illustrates another embodiment of a self-propelled football in an isometric view from the front.
Figure 15:
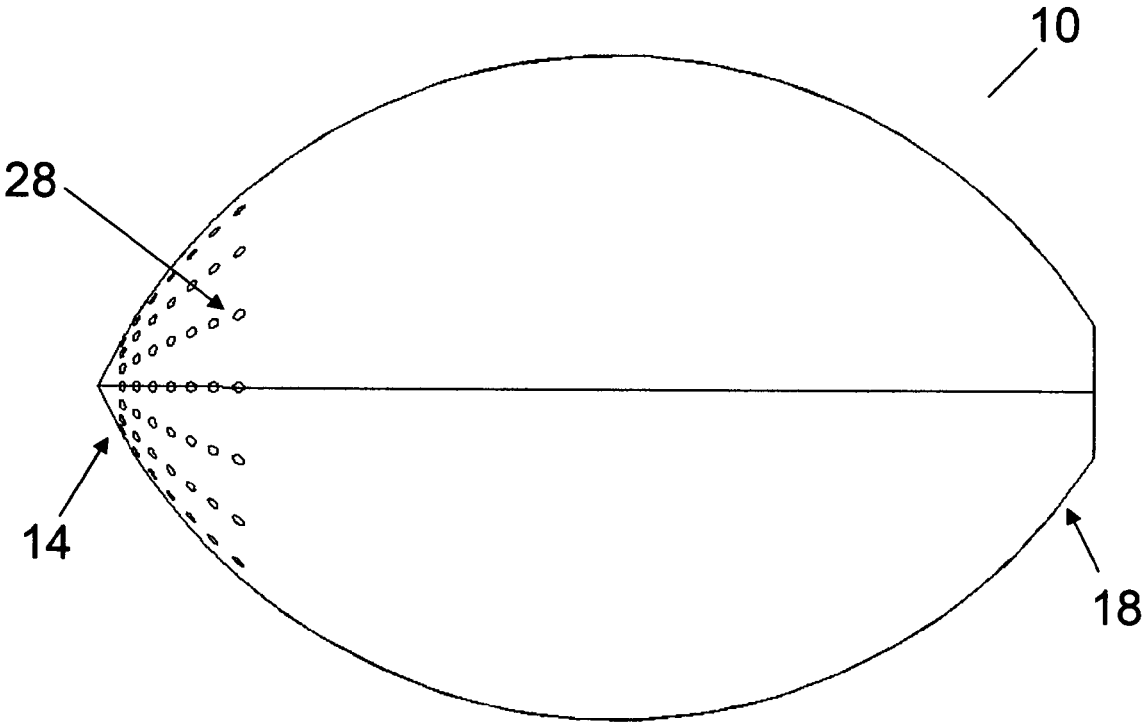
FIG. 15 illustrates the embodiment of FIG. 14 in a side view.

Another embodiment of an air-inlet design is shown in FIGS. 14-15. The air-inlet design is comprised of a multitude of air-inlets 28 in the form of small holes within the front section 14. The small holes would converge to a common opening ahead of the ducted fan 22. The front section 14 would have perforations all along its outer surface while still retaining an outer surface form of a traditional football. As can be seen, a multitude of air-inlet designs can be devised to provide airflow to the ducted fan 22. This specification is not intended to limit the configuration to any one of the exemplary embodiments.

Near the rear section 18 is air-outlet 30. Air-outlet 30 starts behind the ducted fan 22 and converges to a common opening exiting out the rear section 18. Airflow is able to exit through the air-outlet 30 thereby providing thrust for the self-propelled football 10. The air-outlet 30 can be formed in a multitude of shapes and sizes similar to the air-inlet designs previously discussed. Furthermore, the air-outlet 30 can be shaped to induce rotation of the self-propelled football 10 thereby increasing the spiral effect for better in-flight stability. The air-outlet shape would be either right-hand biased or left-hand biased, depending upon the desired spin. Alternatively, the air-outlet 30 may be shaped to counter any torque effect the electric motor 24 may have on the self-propelled football 10. This configuration would allow a self-propelled football 10 to be thrown by either hand. As can be seen, a multitude of air-outlet designs can be devised. This specification is not intended to limit the air-outlet design to any one of the exemplary embodiments.

It may be desirable to have a self-propelled football 10 which can easily activate and deactivate, and there are a multitude of ways to accomplish this. In one embodiment, activating and deactivating the football can be accomplished with on-off switch 32. The on-off switch 32 can control not only the activation, but also the speed of the electric motor 24 with a hi-low functionality, or some other combination thereof. In another embodiment a power level switch can be added to control the hi-low functionality, while leaving the on-off switch 32 to only control activation and deactivation of the electric motor 24.

In another embodiment, it may be desired for the self-propelled football 10 to automatically detect when there is an in-flight condition and a not-in-flight condition. The in-flight condition is when the football has been thrown by the user. The not-in-flight condition is when the football is not in use or being thrown, has been caught or has struck the ground or another object which has stopped its flight. A means for automatic detection would allow the football to automatically activate and deactivate the electrical motor thereby producing thrust only when needed. The user would not have to activate and deactivate a switch during every throw, but would only have to throw the self-propelled football 10 like a traditional football. There are multitude of means for automatic activation and deactivation of the electrical motor by detecting the in-flight condition and the not-in-flight condition, and this specification is not meant to be exhaustive or to limit the means to the precise form disclosed. Many modifications and variations are possible in light of this teaching.

One embodiment of self-activation of the electrical motor 24 is with a microcontroller 36. The microcontroller 36 is in electrical communication with the electrical motor 24 and can control the activation and speed of the electrical motor 24. The microcontroller 36 can be configured to detect when the self-propelled football 10 has been thrown and automatically activate the electrical motor 24. Likewise, the microcontroller 36 can detect when the self-propelled football 10 has been caught or has hit the ground and deactivate the electrical motor 24.

In another embodiment, detecting when the self-propelled football 10 is being thrown or caught can be achieved by using an accelerometer 34. Accelerometer 34 detects g-forces due to gravity, acceleration, and rotation of the football during flight. Accelerometer 34 can be a single axis, double-axis or triple-axis accelerometer. Information from accelerometer 34 is sent to the microcontroller 36. The microcontroller 36 processes the information received from the accelerometer 34 through code preprogrammed into the microcontroller 36. The microcontroller 36 allows the self-propelled football 10 to self-detect when the self-propelled football 10 is being thrown or caught.

There are a multitude of different accelerometer combinations and code that can be devised to self-detect an in-flight condition. Generally speaking, during the beginning of a throw, the self-propelled football 10 is accelerated in a translational direction along the longitudinal axis 20. An accelerometer can be oriented to detect this translational acceleration. Likewise, when the self-propelled football 10 is caught or strikes the ground a deceleration along the longitudinal axis 20 can be measured.

Furthermore, when the self-propelled football 10 is thrown, a spiral motion occurs as the self-propelled football 10 rotates about the longitudinal axis 20. An accelerometer can be oriented to detect the centrifugal force created by the rotation. Code can be devised and preprogrammed into the microcontroller 36 to process the different information provided by accelerometer 34. This specification is not intended to limit itself to any specific embodiment of an accelerometer design and orientation, or microcontroller code.

In yet another embodiment, the microcontroller 36 and accelerometer 34 may be replaced with a device which has a means for detecting centrifugal acceleration caused by the rotation of the self-propelled football 10 about the longitudinal axis 20. As the self-propelled football 10 rotates during a spiral, centrifugal forces are outwardly exerted throughout the body 12 of the self-propelled football 10. A device can be constructed and oriented to sense these centrifugal forces, thereby activating and deactivating the electrical motor 24.

Figure 16:
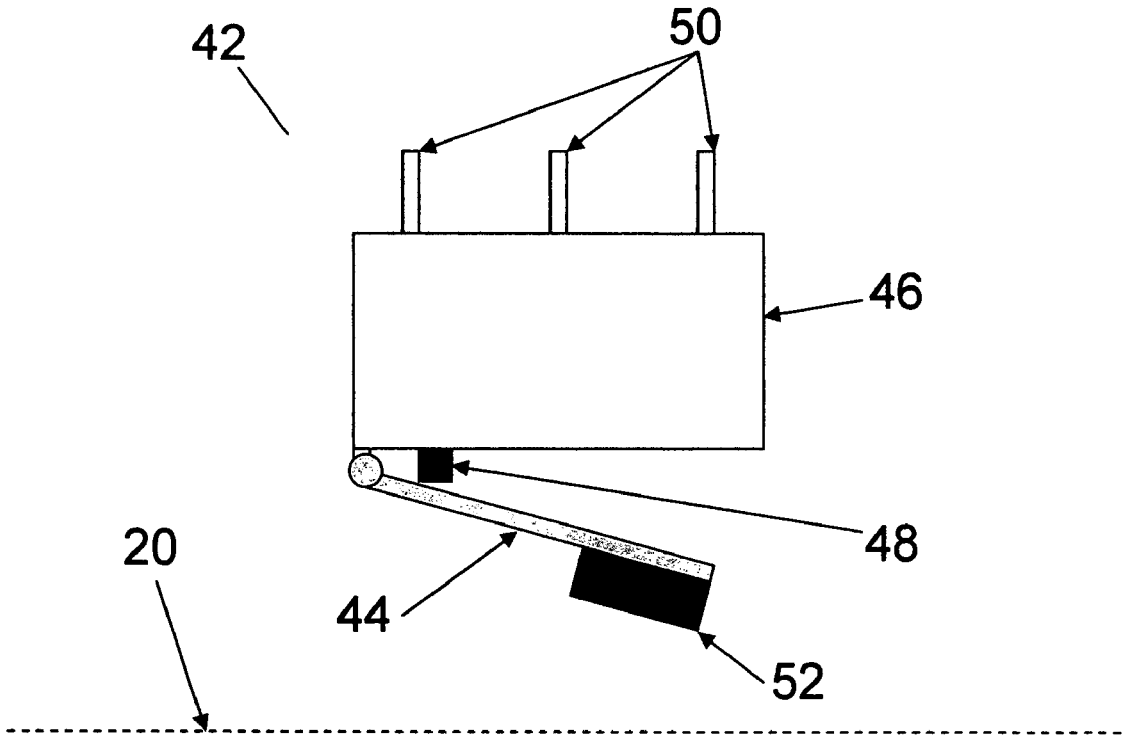
FIG. 16 illustrates an embodiment of a rotational sensing device in a simplified representational view in the open position.
Figure 17:
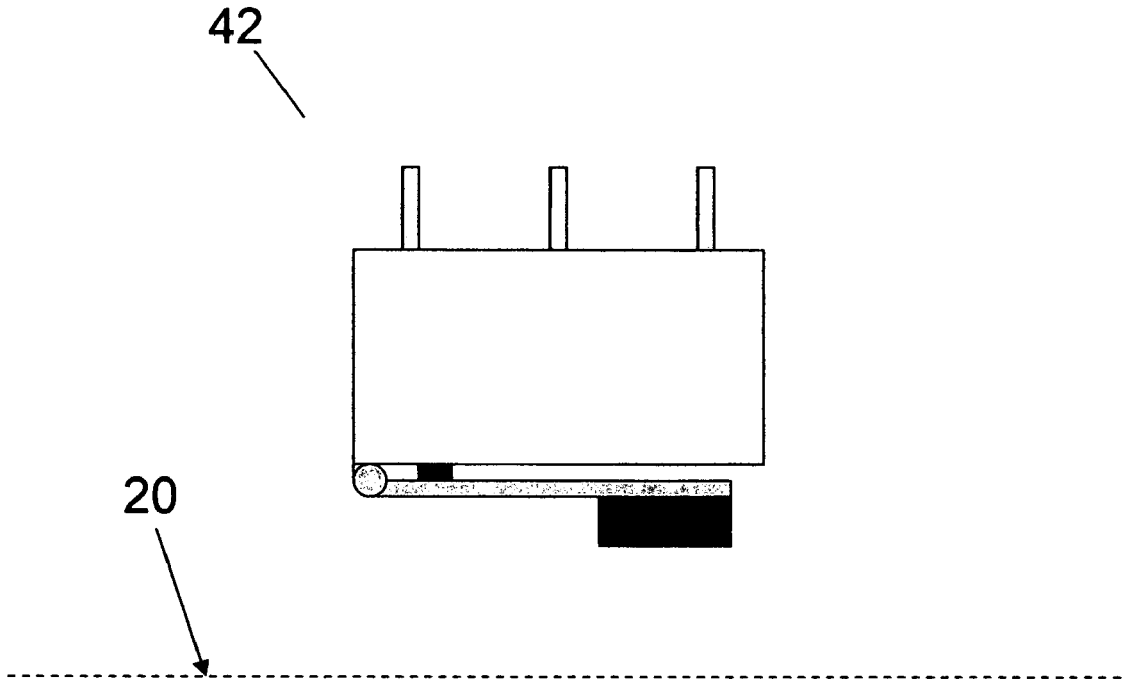
FIG. 17 illustrates the embodiment of FIG. 16 in a simplified representational view in the closed position.
Figure 18:
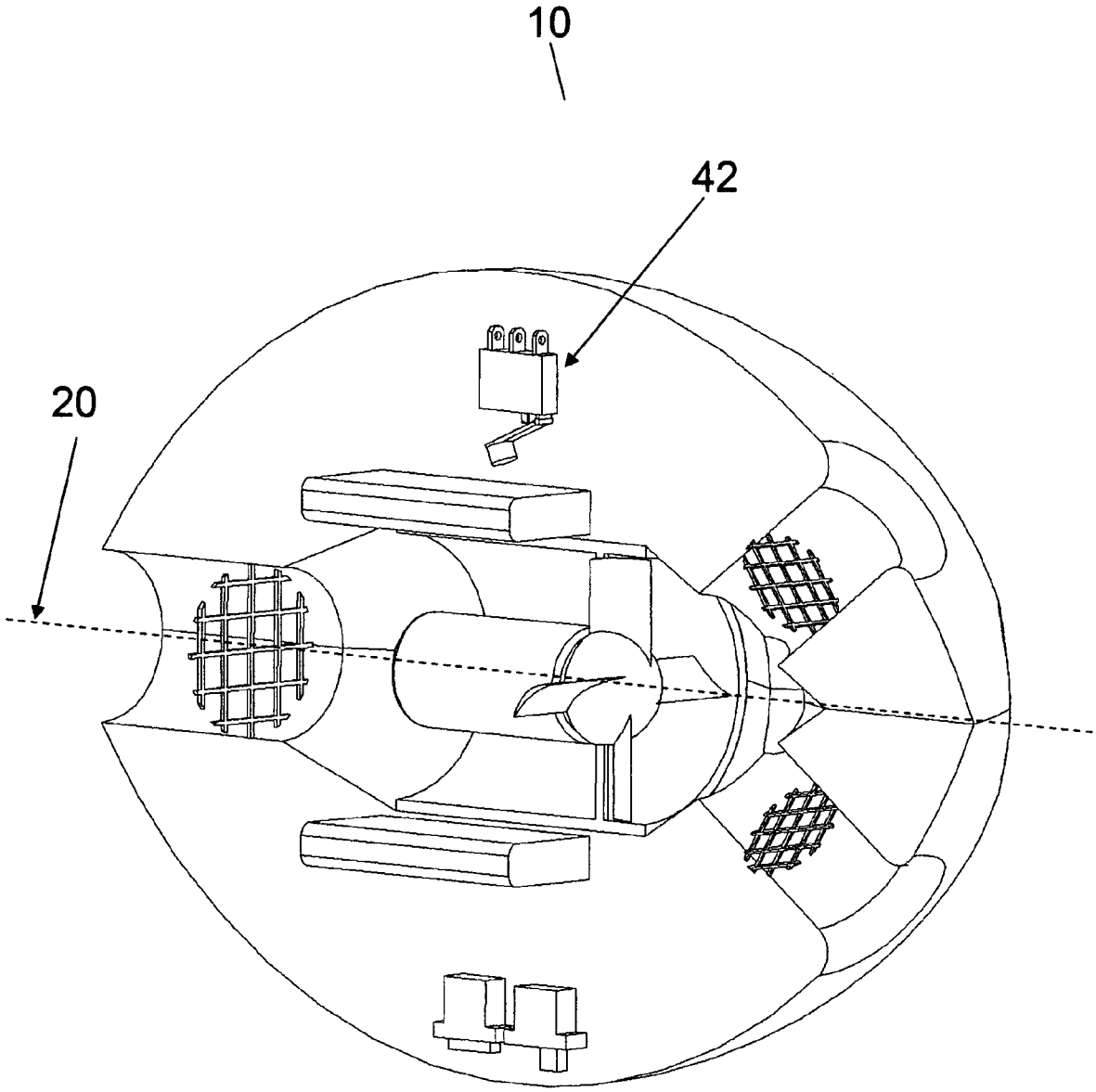
FIG. 18 illustrates the embodiment of FIG. 16 in a cross-sectional isometric view.

One embodiment of such a device is an electro-mechanical switch configured to detect centrifugal forces. An electro-mechanical switch is an electronic switch that controls the flow of current that is activated through mechanical means, such as an acceleration force or g-force. One embodiment of such an electro-mechanical switch is a submini lever switch 42, or also called a basic type snap switch, shown in FIGS. 16-18. The lever switch 42 has a cantilevered lever 44 protruding from switch body 46. Underneath the lever 44 near the pivot point of the lever 44 is button 48. When a force is exerted on the lever 44, it forces the button 48 to depress and activate an electrical circuit. The lever switch 42 is wired to various devices through electrical connection stubs 50.

A weight 52 may be bonded or attached near the end of the lever 44. The lever switch 42 is oriented in the self-propelled football 10 such that the lever 44 is facing towards the longitudinal axis 20. As the self-propelled football 10 is thrown and spirals, centrifugal acceleration exerted on the weight 52 will exert a centrifugal force on the lever 44 forcing the button 48 to be depressed. This will then activate the electrical motor 24. Once the self-propelled football 10 is caught or strikes the ground, spiraling and centrifugal acceleration will slow or stop and the button 48 will release. This can be accomplished by using internal springs located within the switch body 46. The weight 52 will have to be calibrated appropriately to cause activation and deactivation at desired centrifugal forces to overcome the internal spring force of the lever switch 42. There are a multitude of ways of creating an electro-mechanical switch to detect centrifugal acceleration. This embodiment is merely one specific type of an electro-mechanical switch and is not meant to be exhaustive or to limit the means for detecting centrifugal acceleration to the precise form disclosed. Many modifications and variations are possible in light of the above teaching.

Figure 19:
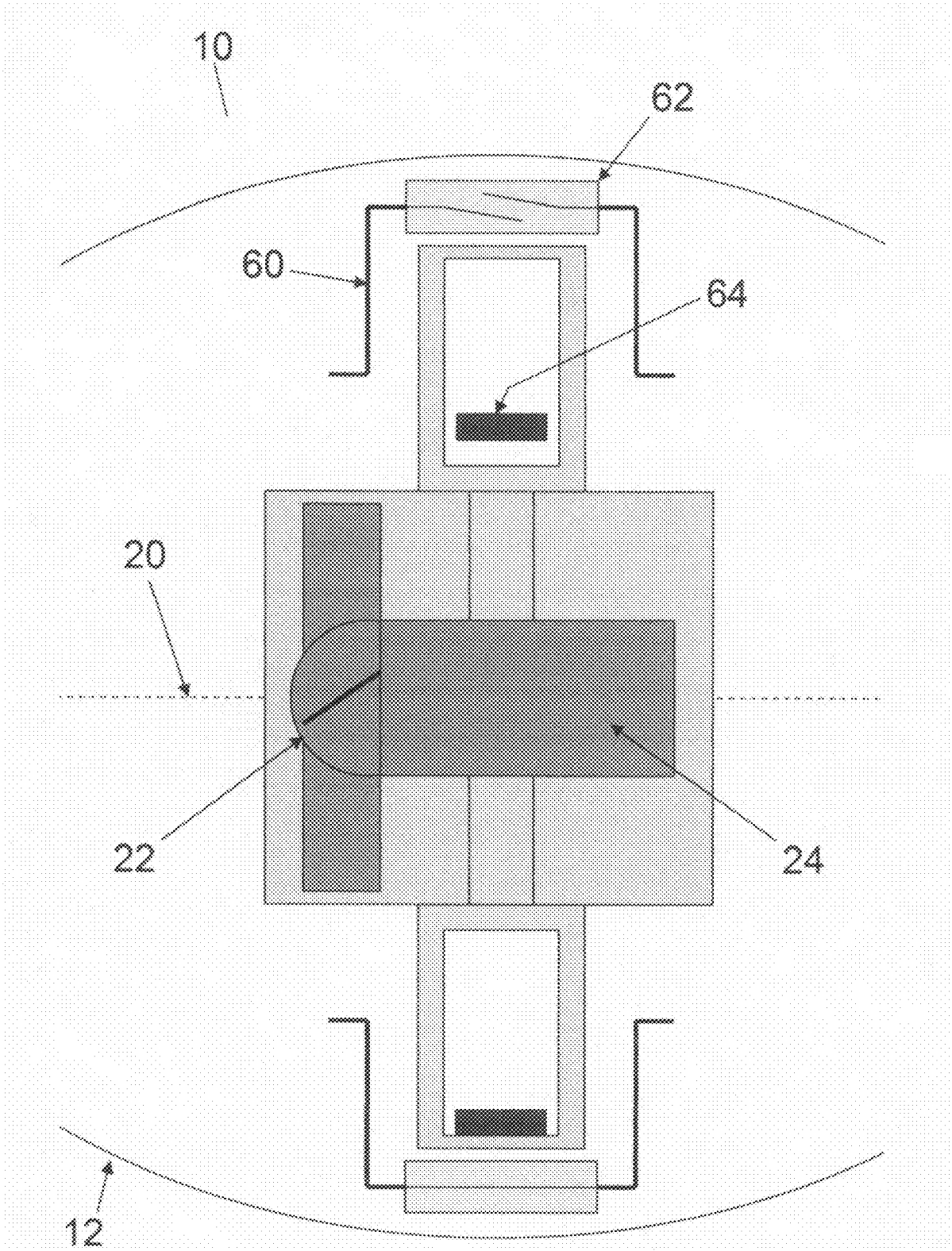
FIG. 19 illustrates another embodiment of a rotational sensing device in a simplified representational view.

Another embodiment of a device which has a means for detecting centrifugal acceleration is through the use of a reed switch 62 and permanent magnet 64, shown in FIG. 19. A reed switch is an electrical switch that is controlled with a magnetic field. Reed switch 62 has two reeds placed in parallel with a small gap in between. These reeds are sensitive to magnetic fields, and can either close or open in the presence of a magnetic field. Normally, the reed switch 62 in the default state is open and not allowing current to flow. When permanent magnet 64 is positioned close to the reed switch 62, the magnetic field from the permanent magnet 64 causes the reed switch 62 to close and thereby allow current to flow through the electrical circuit 60. The self propelled football 10 can have permanent magnets 64 attached in a way that allows the centrifugal forces during a spiral to move the permanent magnet 64 closer to the reed switch 62, thus activating the circuit. As can be seen, there are a multitude of methods of using permanent magnets and reed switches to automatically activate and deactivate the self-propelled football 10 during flight. This specification is not intended to limit the design to any one embodiment.

Figure 20:
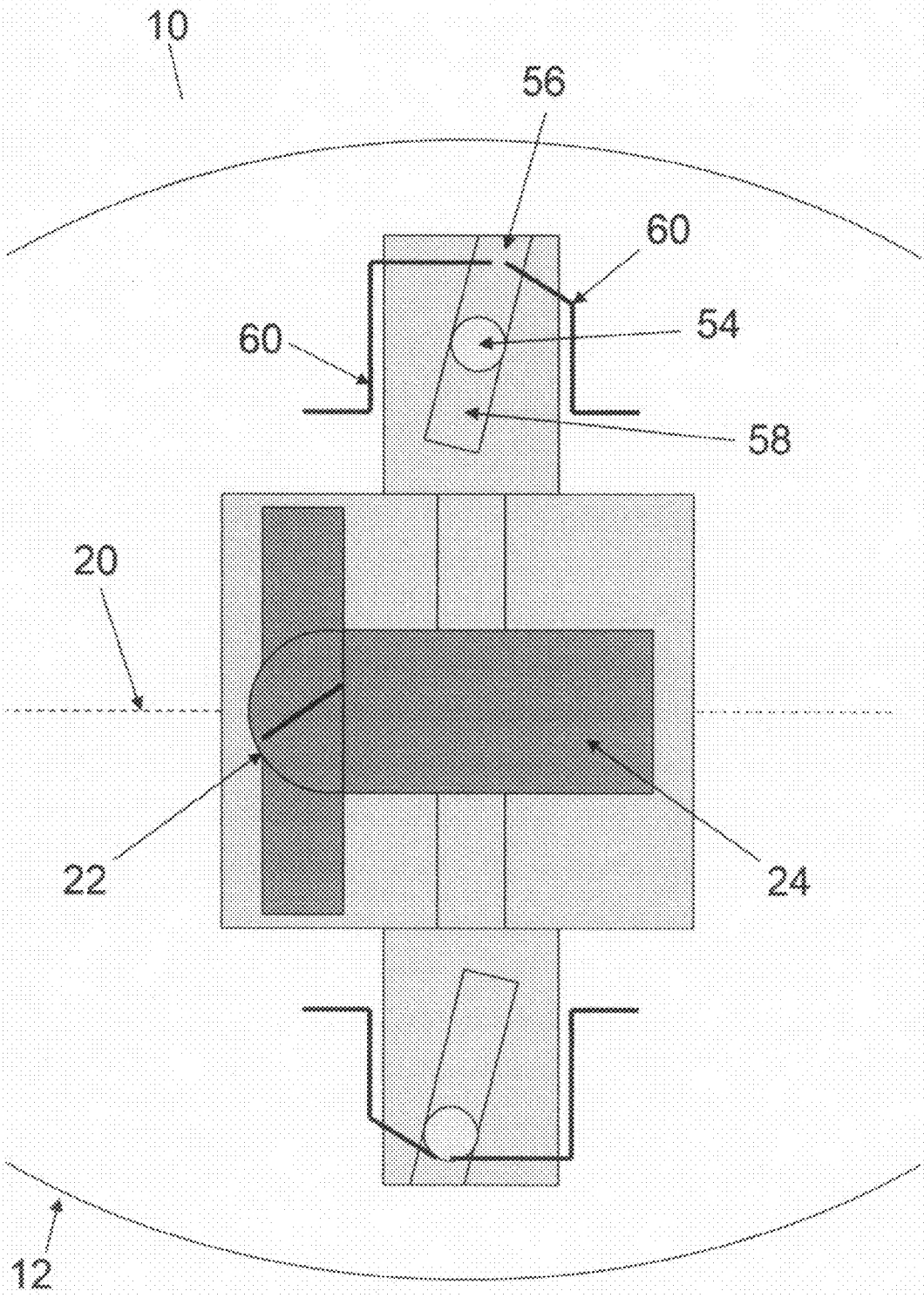
FIG. 20 illustrates another embodiment of a rotational sensing device in a simplified representational view.

Another embodiment of a device for detecting centripetal acceleration is shown in FIG. 20. The use of a conductive mass 54 completes an electrical circuit 60 by bridging a circuit gap 56. The self-propelled football 10 has a cylindrical hole 58, or chamber, substantially perpendicular to the longitudinal axis 20. In one embodiment the conductive mass 54 can be shaped as a sphere and placed within the cylindrical hole 58. Two ends of the electrical circuit 60 are placed at the outermost end of the cylindrical hole 58 with a small gap. When the self-propelled football 10 rotates, centrifugal force moves the conductive mass 54 to touch both ends of the electrical circuit 60, thus bridging the electrical gap. The electrical circuit 60 is then completed and the electrical motor 24 and ducted fan 22 are activated. When the self-propelled football 10 is caught or hits the ground, centrifugal forces cease and the conductive mass 54 moves away from the circuit gap 56 and deactivates the electrical motor 24. The self-propelled football 10 may have several of these devices oriented about the longitudinal axis 20 to prevent inadvertent activation when the self-propelled football is placed in various orientations. As can be seen in FIG. 20, a slight angle to the cylindrical hole 58 helps to reduce the circuit being activated while the self-propelled football 10 is being handled and only activate when thrown. As can be seen, there are a multitude of methods of using different conductive masses and holes configurations to automatically activate and deactivate the self-propelled football 10 during flight. This specification is not intended to limit the design to any one embodiment.

When the conductive mass 54 comes into contact with the electrical circuit 60, an arching affect may occur resulting in damage due to welding or corrosion. Also, as current passes through the conductive mass 54 and electrical circuit 60, the flow of current can cause electrical stiction which will hold the conductive mass 54 against the electrical circuit 60 even after the self-propelled football 10 has come to rest. To prevent and reduce these problems, the conductive mass 54 may be formed from a copper alloy, which is then nickel plated and later gold plated. This reduces corrosion on the contacts, contact resistance, electrical stiction, and welding on the contacts.

The conductive mass 54 may also be comprised of mercury. Mercury switches can handle higher electrical loads and will not corrode over time as a solid conductive mass would. As the self-propelled football 10 is thrown, the conductive mass 54, comprised of mercury, would move towards the electrical circuit 60 and complete the circuit allowing current to flow to the electrical motor 24. Many configurations of mercury switches can be devised to activate and deactivate the electrical motor. This specification is not intended to limit the design to any one embodiment.

A relay may also be used to prevent and reduce corrosion, contact resistance, electrical stiction, and welding on the contacts. A relay is an electrical switch that controls the activation and deactivation of a high electrical current through the control of a low electrical current. The centrifugal switch would be wired to the low power side of the relay, whereas the electrical motor 24 would be wired to the high power side of the relay. When the centrifugal switches are activated on the low power side, it would activate the relay and turn on the high power to the electrical motor 24. Therefore, a much lower current would flow through the conductive mass 54 and lessen corrosion, contact resistance, electrical stiction, and welding on the contacts.

In yet another embodiment, the electrical motor 24 may be controlled by the user during flight through radio controlled technology. This embodiment would employ the same technology used today in radio-controlled cars and aircraft. The user sends a signal from a transmitter through a radio frequency signal to the self-propelled football 10. The self-propelled football 10 has a receiver configured to receive the radio frequency signal. As the self-propelled football 10 travels through the air, the user is able to control the electrical motor 24, thereby controlling the thrust throughout flight. It would be desirable to create a transmitter that could be controlled with one hand while allowing the other hand available to throw the self-propelled football 10. It would also be desirable to create a transmitter that would allow the user to also catch the self-propelled football 10 by allowing both hands to remain free and open. One such embodiment may be to integrate the transmitter into a glove for the user to wear. This would allow both hands to remain open to catching a football as opposed to holding onto a transmitter. As can be seen, there are a multitude of transmitters designs that could be configured for controlling the self-propelled football 10. This specification is not intended to limit the design to any one embodiment.

In another embodiment, the body 12 may be made from a compressible, flexible and resilient material. One such material is plastic-foam. This plastic-foam material is elastic and lessens the impact from a missed catch. Also, the material would lessen the impact on the internal mechanisms within the self-propelled football 10. Many such materials are already in use today, especially for various children toys. Some examples of these materials can be constructed from polyethylene, polyurethane, neoprene, polystyrene, sponge rubbers and various other materials. As can be seen there are a multitude of suitable foams for the body 12. Furthermore, the body 12 may be comprised of a multitude of varying foam types. In an exemplary embodiment, the body may be comprised of a stiff-type foam that is substantially lighter in density. Then, an elastic foam would comprise an outer shell of the body. This configuration would allow for an overall lighter body than could be made from just one type of foam. This would help reduce overall weight while retaining an impact absorbing outer shell. As can be seen, there are a multitude of foam configurations that could be desirable. This specification is not intended to limit the scope to any one particular configuration or material type.

In another embodiment an air-permeable structure 38 can be located within the air-inlet 28 and air-outlet 30. The air-permeable structure 38 can be made of a mesh material, a netting material, or any similar construction that allows air to pass through while stopping foreign particles. The air-permeable structure 38 acts as a filter and prevents foreign particles from entering the ducted fan and causing a clogged condition or internal damage. Also, the air-permeable structure 38 would prevent a user from sticking objects into the self-propelled football 10, such as fingers or twigs.

In another embodiment, it would be desirable for all the components of the self-propelled football 10 to be designed to keep the weight at or below the weight of a traditional football. It is also desirable to balance the self-propelled football 10 so the center of gravity is at or near the center of the football. Proper weight and balance will allow the user to throw the self-propelled football 10 in the same manner as one would throw a traditional football.

In another embodiment a charging port 40 would be located on the body 12. A typical electric ducted fan airplane can fly for about twenty minutes. The ducted fan 22 within the self-propelled football 10 would only be in operation when thrown. This would allow the playing time to be extended well beyond twenty minutes. Once the electrical power source 26 was depleted, the self-propelled football 10 would be plugged into a charger through the charging port 40 and be ready for use once again. It is desirable to locate the charging port in a location that is easy to access and does not require disassembling the self-propelled football 10.

Furthermore, it may be desirable to configure the electrical motor 24 to rotate in a direction that helps to increase the spiraling effect of the self-propelled football 10 when thrown.

As the electrical motor 24 spins the ducted fan 22, this creates a torque that will either increase or decrease the spiraling effect of the self-propelled football 10. Depending on specific configurations of the ducted fan 22 and electrical motor 24, this force may be slight or significant. It may be desirable to increase the stability of the self-propelled football 10 by increasing the spiraling effect, not decreasing it. Attention must be paid to the rotation of the electrical motor 24 being dependent on whether the self-propelled football 10 is thrown right-handed or left-handed.

In one embodiment, it may be desirable to include a timer or to build in a preset time limit for the running of the electrical motor 24. This is to prevent an overly long run time caused by a farther than wanted throw or when throwing the football straight up. There are many ways to achieve this functionality. In one embodiment, the microcontroller 36 can be programmed to include timing logic to detect when a preset runtime has elapsed and deactivate the electrical motor. This would prevent an over-flight condition where the user has thrown the football straight up and the self-propelled football 10 will not be caught or hit the ground to deactivate the electrical motor 24. This functionality can also limit the amount of time the electrical motor 24 is activated during any single throw for various reasons. In another embodiment after the electrical motor 24 has been activated, a timer will automatically turn off the electrical motor 24 after a predetermined time. In another embodiment, a simplistic timing circuit may be utilized to stop the electrical motor 24 from an overly long run time. As can be seen, there are a multitude of ways of creating a timer. This specification is not intended to limit the scope to any one particular type.

In another embodiment, the self-propelled football 10 can also include lights disposed along the body 12 that light up when thrown. These lights would allow the football to be played in low light conditions. Also, special paint may be used to make the ball glow in the dark. Many paints are offered on the market that absorb light during daytime conditions and then glow at night. Also, a whistle may be integrated into the self-propelled football that creates a whistling noise as the ball is thrown. This whistle may be integrated on the outside of the body 12 or also inside the air-inlet 28 or air-outlet 30. These described features add to the novelty of the self-propelled football 10.

Figure 21:
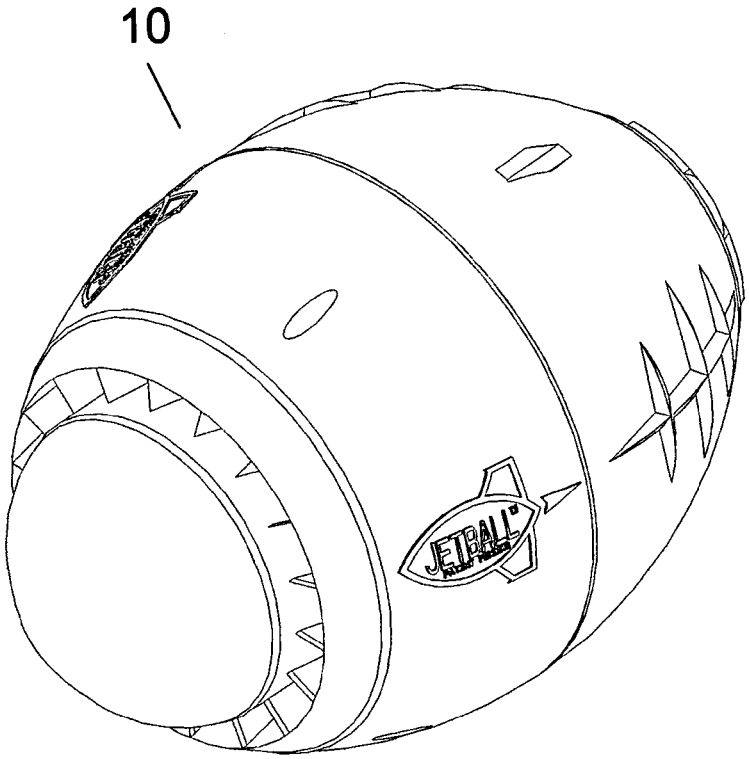
FIG. 21 illustrates another embodiment of a self-propelled football in an isometric view with two sets of counter-rotating ducted fans.
Figure 22:
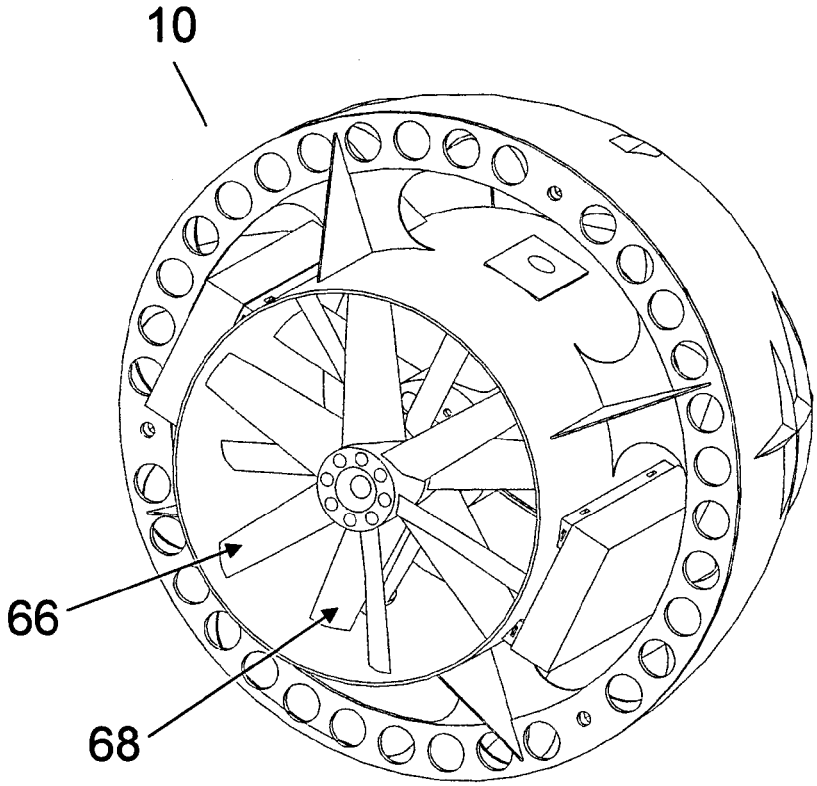
FIG. 22 illustrates the embodiment of FIG. 21 with the front half of the football removed to expose the two sets of counter-rotating ducted fans.

In another embodiment, the self-propelled football 10 may have two sets of ducted fans, first ducted fan 66 and second ducted fan 68, as shown in FIGS. 21-22. When a self-propelled football 10 with a single ducted fan is thrown, the electrical motor 24 spins the ducted fan 22, and the self-propelled football 10 will tend to rotate opposite the ducted fan 22. This will either help the spin or hurt the spin during a throw, depending on whether the self-propelled football 10 was thrown right-handed or left-handed. By diverting air exiting the self-propelled football 10, this torque effect can be minimized, eliminated or increased. Many ducted fan units used for radio control airplanes have support columns which hold the electrical motor place that are intentionally shaped to reduce the torque effect. As air rushes past the support columns, the torque of the fan is countered by a redirection of the airflow. This allows the airplane to fly straight without having to constantly fight a tendency to spin during flight.

However, when the electrical motor 24 starts to spin from a dead stop, there is not sufficient airflow to create a counter-torque. Thus the self-propelled football 10 will still have a torque effect during a throw. One way to eliminate this torque effect and provide a universal version of the self-propelled football 10 is by using two ducted fans that spin in opposite directions. When two sets of fans rotate in opposite directions, each fan's torque effect is canceled out by the other fan. This allows the self-propelled football to be thrown equally well by left-handed and right-handed users. Many radio control helicopters utilize a similar mechanical design for the main rotors in that there are two counter-rotating main blades. These blades are mechanically coupled to the motor to rotate in opposite directions. A similar setup can be designed and integrated into the self-propelled football 10. The first ducted fan 66 will rotate in an opposite direction of the second ducted fan 68. Each fan's torque cancels the other and the self-propelled football 10 remains neutral during a throw and has no torque effect. As can be seen, there are a multitude of dual counter-rotating fan designs that could be desirable. This specification is not intended to limit the scope to any one particular configuration.

Figure 23:
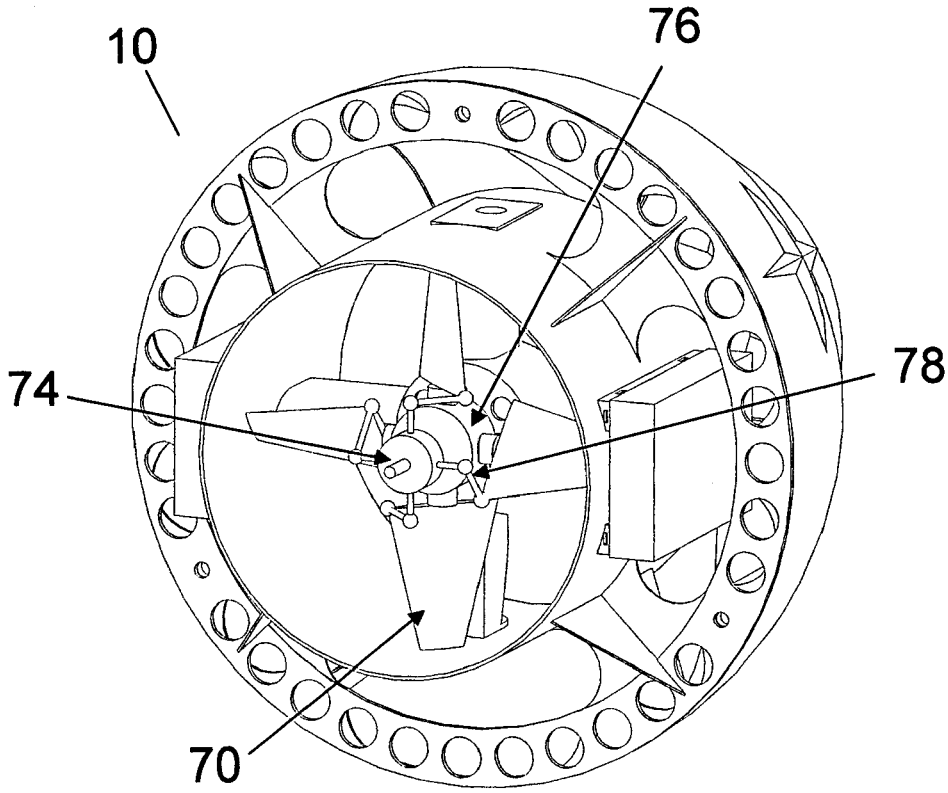
FIG. 23 illustrates another embodiment of a self-propelled football with the front half of the football removed to expose a pitch adjustable ducted fan.

In another embodiment, the self-propelled football 10 may have a pitch adjustable (also called a variable pitch) ducted fan 70 as shown in FIG. 23. Many remote control helicopters have a mechanical means for adjusting the pitch of the main rotor blades and also adjusting the pitch of the tail rotor blades. This allows different levels of thrust to be accurately controlled. A similar setup can be used within the self-propelled football 10. In an exemplary embodiment, each blade is connected to a main hub 76 and can rotate in an axis that is perpendicular to the longitudinal axis, thereby allowing the pitch on each blade to change. Each blade is mechanically linked to a sliding hub 74 capable of moving forwards and backwards. When the sliding hub 74 moves forward and backwards, it causes each blade on the ducted fan 70 to change angle through the linkage 78 attached to each blade. As can be seen, there are a multitude of pitch adjustable fan configurations and pitch control mechanisms that could be desirable. This specification is not intended to limit the scope to any one particular configuration.

In another exemplary embodiment it may desirable to control the pitch of each blade through an additional servo controlled by a microprocessor. The microprocessor can adjust the angle of the blades throughout the flight of a self-propelled football 10. It may be desirable to change the angle of attack (pitch) to either increase or decrease thrust during a throw. In another exemplary embodiment it may be desirable to have a selector on the self-propelled football 10 where the user can select different pitch angles. This would allow the user to select different thrust levels manually. This selector may also be electrically controlled or mechanically controlled through a selector.

Furthermore, in another exemplary embodiment a user could select between either right-hand throw or left-hand throw through a selector. When the user selects between right-hand throw to left-hand throw, or vice versa, the angle on the blades flip about 90 degrees and the rotation of the electrical motor 24 is also switched electrically to rotate in the opposite direction. Flipping the angle on the blades and rotation of the motor allows the self-propelled football 10 to spiral in the opposite direction. Then the user could throw the football and the torque effect would be in the correct rotation for all users. As can be seen, there are a multitude of pitch adjustable fan configurations that could be desirable. This specification is not intended to limit the scope to any one particular configuration.

Figure 24:
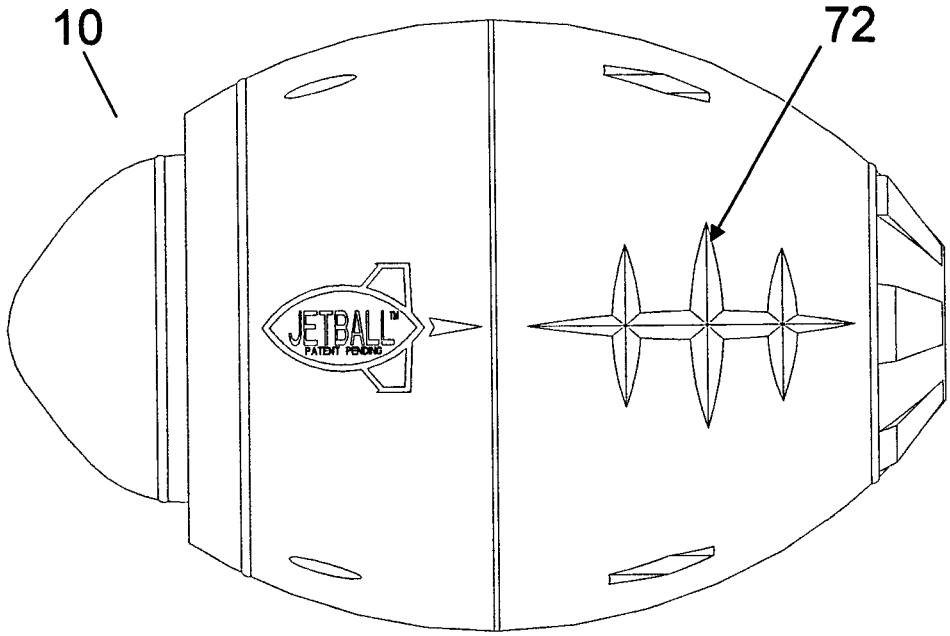
FIG. 24 illustrates an embodiment of a self-propelled football in side view to show an embodiment of a lace design.
Figure 25:
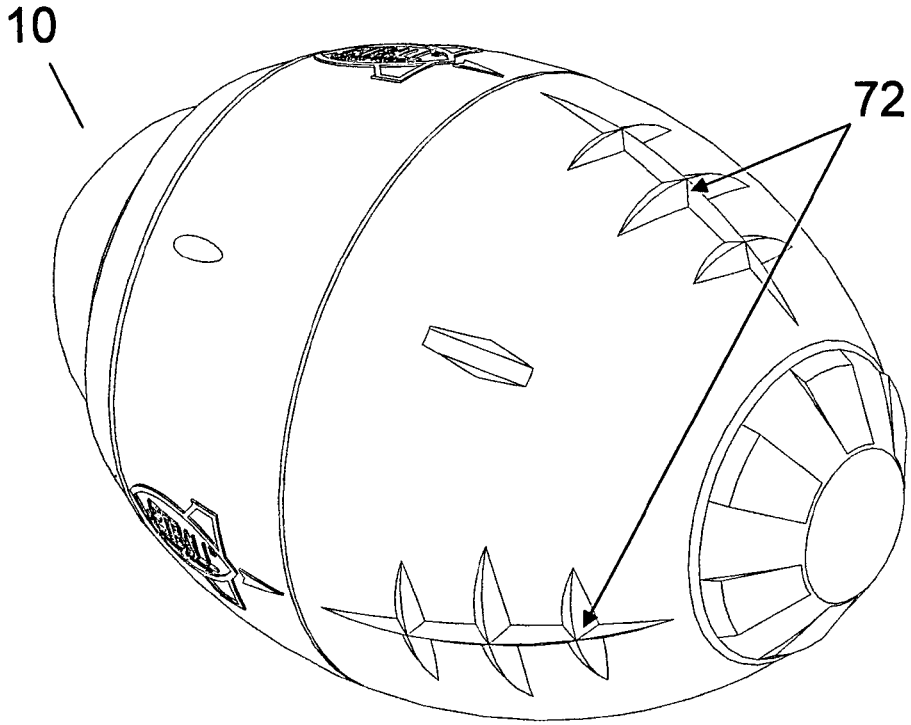
FIG. 25 illustrates the embodiment of FIG. 24 in an isometric view.
Figure 26:
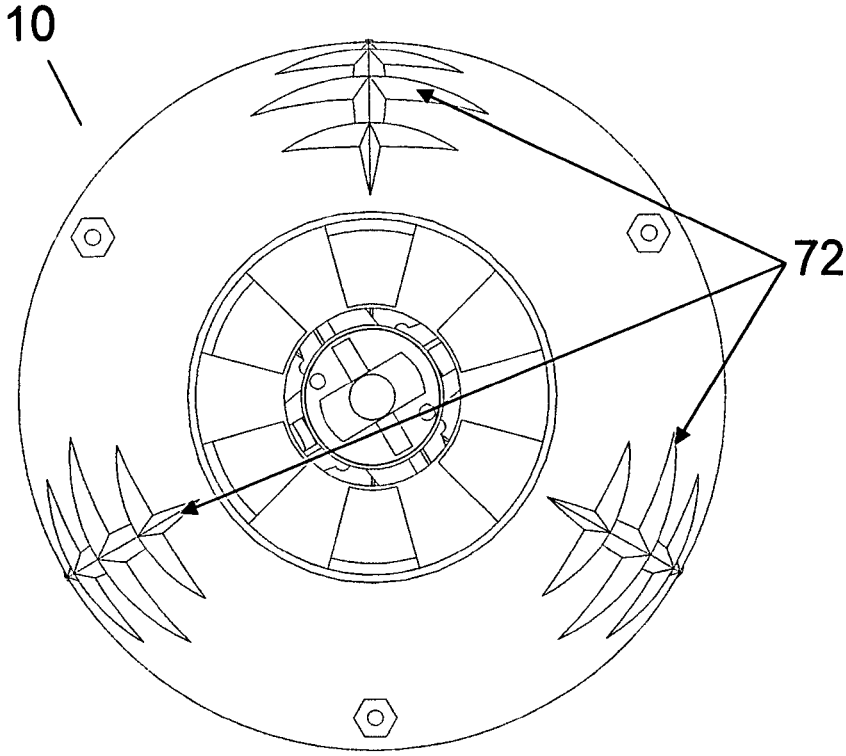
FIG. 26 illustrates the embodiment of FIG. 24 in a rear view.

In another exemplary embodiment, the self-propelled football 10 may have a new lace design 72 as shown in FIGS. 24-26. A traditional football has a single set of laces on the surface of the football along the center section that is planar with the longitudinal axis. The laces are planar with the longitudinal axis, meaning that the laces and longitudinal axis lie on a similar plane that goes through both the longitudinal axis and the laces. These laces are traditionally located only along the center section of a standard football, and do not extend to the ends of the football. This is required because the football does not have a defined front and rear section and can be thrown either way. When a user grasps the traditional football, it is common to place the hand along the rear section of the football, which means usually only the ring finger and pinky finger can actually grasp the laces. On smaller footballs, the middle finger may be able to grip the laces as well, yet it is very uncommon for a user to have all four fingers on the laces. However, it is common for most people who throw a traditional style football to automatically rotate the football within their grasp until they feel the laces and place their fingers so that they can grip the laces. An increased grip is highly desirable, as most people will naturally perform this lace manipulation when throwing a football. Therefore, increasing this grip is desired and will allow better accuracy and control.

By placing the laces 72 behind the center of the football and predominantly along the rear of the self-propelled football 10, more laces can be grasped by more fingers. This means there is less of a chance of the self-propelled football 10 from slipping out prematurely during a throw. In another exemplary embodiment, more than one set of laces may be used. This could mean two sets, three sets, or even four sets of laces may be placed around the self-propelled football 10 to make it easier and quicker to find a better grip. In an exemplary embodiment, when more than one set of laces are used, it is advantages to space each lace out equally from each other. This means that two laces would be 180 degrees apart, three laces would be 120 degrees apart, and four laces would be 90 degrees apart. This equal spacing minimizes the time required to find a lace for gripping while also remaining aesthetically appealing. In an exemplary embodiment, a set of three laces would allow a user to place the front four fingers on one set of laces, while the thumb could be placed on a second set of laces 120 degrees apart, thereby increasing the grip substantially. The actual design of the laces themselves may take the shape of many designs. For instance, protrusions, depressions, or combinations thereof may be used to increase the grip. As can be seen, there are a multitude of lace designs that could be desirable. This specification is not intended to limit the scope to any one particular configuration. It is explained here to show how moving the laces from the center of a football to the rear of a football results in a better self-propelled football 10.

There are two basic common types of electrical motors; brushed and brushless. Using a brushless electric motor, as opposed to a brushed electric motor, is more energy efficient and can produce more thrust due to a higher rotational speed. This can result in a self-propelled football 10 with a much higher thrust output, meaning the football will fly farther and faster. However, the brushless motor needs more complicated electronics to properly operate. A controller is needed to control the rotation of the brushless motor, since it does not automatically switch electricity when rotating as does a brushed motor. Many electronic speed controllers (ESCs) are available for remote control airplanes using brushless electric motors. These ESCs are small and lightweight, and a similar controller can be designed to fit within a self-propelled football 10.

To make a lighter weight football, lithium polymer (LiPo) batteries have more power and less weight than other traditional battery technology. However, LiPo batteries should never be fully discharged, as this may hurt the batteries ability to hold a charge at all. Therefore, a cutoff voltage should be designed into the football's electronics to automatically turn off the motor once a predetermined low voltage condition is reached. This saves the life of the battery and allows them to be properly recharged at a later time.

In another exemplary embodiment, the duct profiles of the air-inlet 28 and air-outlet 30 are extremely important for the fan to perform well. The air-inlet 28 needs to be large enough to supply the required air to the fan at both low and high speeds, which can occur at the beginning of the throw and at the end of the throw. However, if the duct profile is too large, it could increase the football's drag coefficient or decrease the fan's efficiency. As a rule of thumb, based off radio controlled aircraft using ducted fans on a single inlet/outlet design, the air-inlet 28 should be about 130 percent the area of fan swept area. This may be less for a ring air-inlet design as shown in FIGS. 10-13. The air-outlet 30 should be about 100 percent of the fan swept area or slightly less. Put simply, a larger air-outlet 30 will help create more thrust but will decrease the air exit speed. A smaller air-outlet 30 will increase the air exit speed but will decrease thrust. The self-propelled football 10 will initially have a starting velocity above zero, as the self-propelled football 10 is thrown forward with an initial velocity. To gain a further distance thrown, the air-outlet 30 should be less than the fan swept area to increase air exit speed. For instance the air-outlet 30 could be around 90 percent of fan swept area, or even less. In another exemplary embodiment, it is desirable to have a duct profile that is smooth and free of obstacles, as thrust is lost due to obstructions and air flow restrictions. Furthermore, based off of radio controlled aircraft, it is also desirable to have an intake design that has a smooth and rounded lip. This helps maximize thrust and smooth airflow. As can be seen, there are a multitude of designs that could help create an efficient ducted fan through various air-inlet 28 and air-outlet 30 designs. This specification is not intended to limit the scope to any one particular configuration.

In another exemplary embodiment the electrical power source 26, which may be a Lithium Polymer battery, can discharge at a high rate. This means that when the self-propelled football 10 is being thrown, the batteries will tend to heat up. To minimize this, it may be desirable to heat sink the batteries against the ducted fan housing such that as air passes through the ducted fan housing, it will pull the heat out of the battery by conduction through the duct fan housing and then through convection from the air rushing quickly past it. In another exemplary embodiment, it may be desirable to direct an amount of airflow past the battery to also help cooling. As can be seen, there are a multitude of designs that could help reduce heat buildup in the batteries. This specification is not intended to limit the scope to any one particular configuration.

The foregoing description of the exemplary embodiments have been presented for the purposes of illustration and description. It is not intended to be exhaustive or to limit the invention to the precise form disclosed. Many modifications and variations are possible in light of the above teaching that others can, by applying current knowledge, readily modify and/or adapt for various applications such specific embodiments without undue experimentation and without departing from the generic concept. Therefore, such adaptations and modifications should and are intended to be comprehended within the meaning and range of equivalents of the disclosed embodiments. It is to be understood that the phraseology or terminology employed herein is for the purpose of description and not of limitation. It is intended that the scope of the invention not be limited by this detailed description, but rather by the claims appended hereto and all equivalents thereto.

Thus the expression "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

REFERENCE NUMBER LIST

10 Self-Propelled Football
12 Body
14 Front Section
16 Center Section
18 Rear Section
20 Longitudinal Axis
22 Ducted Fan
24 Electric Motor
26 Electrical Power Source
27 Structural Supports
28 Air-Inlet
30 Air-Outlet
32 On-Off Switch
34 Accelerometer
36 Microcontroller
38 Air-Permeable Structure
40 Charging Port
42 Lever Switch
44 Lever
46 Switch Body
48 Button
50 Electrical Connection Stubs
52 Weight
54 Conductive Mass
56 Circuit Gap
58 Cylindrical Hole
60 Electrical Circuit
62 Reed Switch
64 Permanent Magnet
66 First Ducted Fan
68 Second Ducted Fan
70 Pitch Adjustable Single Ducted Fan
72 Laces
74 Sliding Hub
76 Main Hub
78 Linkage

I claim:

1. A self-propelled football comprising:

(a) an oblate spheroidal body having a front section, a center section, a back section, and a longitudinal axis;

(b) a first ducted fan located within the body substantially within the center section and substantially along the longitudinal axis;

(c) a second ducted fan located within the body substantially within the center section and substantially along the longitudinal axis and positioned adjacent to the first ducted fan;

(d) an electric motor located within the body and mechanically coupled to the first ducted fan and the second ducted fan;

(e) at least one electrical power source located within the body and electrically coupled to the electric motor;

(f) at least one air-inlet located within the front section having airflow communication with the first and second ducted fans; and (g) at least one air-outlet located within the back section having airflow communication with the first and second ducted fans.

2. The self-propelled football of claim 1, wherein the first ducted fan rotates in a first rotational direction and the second ducted fan rotates in a second rotational direction wherein the first rotational direction is opposite the second rotational direction.

3. The self-propelled football of claim 2, further including a means for automatic activation and deactivation of the electrical motor by detecting an in-flight condition and a not-in-flight condition, wherein such means is located within the body and in electrical communication with the electrical motor and the electrical power source.

4. The self-propelled football of claim 3, further including a first set of laces located approximately along the back section of the oblate spheroidal body and planar to the longitudinal axis.

5. The self-propelled football of claim 4, further including a second set of laces located approximately along the back section of the oblate spheroidal body and planar to the longitudinal axis, wherein the second set of laces are rotated 180 degrees from the first set of laces about the longitudinal axis.

6. The self-propelled football of claim 4, further including a second set of laces located approximately along the back section of the oblate spheroidal body and planar to the longitudinal axis, wherein the second set of laces are rotated 120 degrees from the first set of laces about the longitudinal axis, and further including a third set of laces located approximately along the back section of the oblate spheroidal body and planar to the longitudinal axis, wherein the third set of laces are rotated 120 degrees from the first and second set of laces about the longitudinal axis.

7. The self-propelled football of claim 6, wherein the body is comprised of a compressible and resilient material.

8. The self-propelled football of claim 7, further including an air-permeable structure connected to the oblate spheroidal body disposed along the air-inlet and air-outlet, such that an airflow can be drawn through the air-inlet and air-permeable structure by the first and second ducted fans and expelled through the air-permeable structure and air-outlet, thereby creating a forward thrust while preventing a foreign particle from traveling through the ducted fan, and further including an on-off switch connected to the body and electrically coupled to the electrical motor and electrical power source, and further including a charging port connected to the body in electrical communication with the electrical motor and electrical power source.

9. A self-propelled football comprising:

(a) an oblate spheroidal body having a front section, a center section, a back section, and a longitudinal axis;

(b) a variable pitch ducted fan comprised of a main hub and a plurality of rotatable blades rotatably attached to the main hub, wherein the variable pitch ducted fan is located within the body substantially within the center section and substantially along the longitudinal axis, wherein the plurality of rotatable blades rotate in a pitch rotation which is perpendicular to the longitudinal axis and is controlled by a pitch control mechanism located within and mechanically attached to the self-propelled football;

(c) an electric motor located within the body and mechanically coupled to the variable pitch ducted fan through the main hub;

(d) at least one electrical power source located within the body and electrically coupled to the electric motor;

(e) at least one air-inlet located within the front section having airflow communication with the variable pitch ducted fan;

(f) at least one air-outlet located within the back section having airflow communication with the variable pitch ducted fan; and (g) a hand throw selector connected to the oblate spheroidal body, wherein the hand throw selector is mechanically coupled to the pitch control mechanism and electrically coupled to the electrical motor, such that the hand throw selector reverses the rotation of the electrical motor and moves the pitch control mechanism to reverse the pitch rotation.

10. The self-propelled football of claim 9, further including a means for automatic activation and deactivation of the electrical motor by detecting an in-flight condition and a not-in-flight condition, wherein such means is located within the body and in electrical communication with the electrical motor and the electrical power source.

11. The self-propelled football of claim 10, further including a first set of laces located approximately along the back section of the oblate spheroidal body and planar to the longitudinal axis, and further including a second set of laces located approximately along the back section of the oblate spheroidal body and planar to the longitudinal axis, wherein the second set of laces are rotated 120 degrees from the first set of laces about the longitudinal axis, and further including a third set of laces located approximately along the back section of the oblate spheroidal body and planar to the longitudinal axis, wherein the third set of laces are rotated 120 degrees from the first and second set of laces about the longitudinal axis.

12. The self-propelled football of claim 11, wherein the body is comprised of a compressible and resilient material.

13. The self-propelled football of claim 12, further including a timer located within the body in electrical communication with the electrical motor and the electrical power source, wherein the electrical motor, after activation, will automatically turn off after a predetermined time.

14. The self-propelled football of claim 13, further including a low voltage cutoff located within the body in electrical communication with the electrical motor and the electrical power source, wherein once the voltage from the electrical power source drops below a predetermined level, voltage supplied to the electrical motor is severed.

15. A self-propelled football, comprising:

(a) a body shaped as an oblate spheroid having a substantially symmetrical shape about a longitudinal axis, wherein the body is further defined as having a front section, a center section, and a back section, wherein the longitudinal axis extends from the front section, through the center section, and to the back section, and wherein the body is comprised of a compressible and resilient material;

(b) a ducted fan located within the body substantially along the center section and substantially aligned with the longitudinal axis;

(c) an electric motor located within the body mechanically coupled to the ducted fan wherein the electrical motor is brushless;

(d) at least one electrical power source located within the body and electrically coupled to the electric motor wherein the electrical power source is a lithium polymer rechargeable battery;

(e) a brushless motor controller located within the body and electrically coupled to the electric motor and electrical power source;

(f) at least one air-inlet disposed along the front section of the body in airflow communication with the ducted fan;

(g) at least one air-outlet disposed along the back section of the body in airflow communication with the ducted fan, such that an airflow can be drawn through the air-inlet by the ducted fan and expelled through the air-outlet thereby creating a forward thrust; and (h) a means for automatic activation and deactivation of the electrical motor by detecting an in-flight and a not-in-flight condition located within the body and in electrical communication with the electrical motor and the electrical power source.

16. The self-propelled football of claim 15, further including a timer located within the body in electrical communication with the electrical motor and the electrical power source, wherein the electrical motor, after activation, will automatically turn off after a predetermined time.

17. The self-propelled football of claim 16, further including a low voltage cutoff located within the body in electrical communication with the electrical motor and the electrical power source, wherein once the voltage from the electrical power source drops below a predetermined level, voltage supplied to the electrical motor is severed.

18. The self-propelled football of claim 17, wherein the body is comprised of a compressible and resilient material.

19. The self-propelled football of claim 18, further including an air-permeable structure connected to the body disposed along the air-inlet and air-outlet, such that an airflow can be drawn through the air-inlet and air-permeable structure by the ducted fan and expelled through the air-permeable structure and air-outlet, thereby creating a forward thrust while preventing a foreign particle from traveling through the ducted fan, and further including an on-off switch connected to the body and electrically coupled to the electrical motor and electrical power source, and further including a charging port connected to the body in electrical communication with the electrical motor and electrical power source.

* * * * *